US012259180B2

(12) United States Patent
Choi

(10) Patent No.: US 12,259,180 B2
(45) Date of Patent: Mar. 25, 2025

(54) REFRIGERATOR

(71) Applicant: LG Electronics Inc., Seoul (KR)

(72) Inventor: Kwanghyun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/204,804

(22) Filed: Jun. 1, 2023

(65) Prior Publication Data

US 2023/0304729 A1 Sep. 28, 2023

Related U.S. Application Data

(63) Continuation of application No. 17/576,032, filed on Jan. 14, 2022, now abandoned, which is a (Continued)

(30) Foreign Application Priority Data

Nov. 20, 2019 (KR) ..... 10-2019-0149565

(51) Int. Cl.
*F25D 25/02* (2006.01)
*A47B 88/90* (2017.01)
(Continued)

(52) U.S. Cl.
CPC ..... *F25D 25/025* (2013.01); *A47B 88/90* (2017.01); *F25D 23/028* (2013.01);
(Continued)

(58) Field of Classification Search
CPC .... F25D 25/025; F25D 25/022; F25D 25/005; F25D 25/04; F25D 23/028; F25D 23/021;
(Continued)

(56) References Cited

U.S. PATENT DOCUMENTS 7,600,832 B2 * 10/2009 Oh ..... F25D 25/025 312/402
7,849,789 B1 12/2010 Whelan
(Continued)

FOREIGN PATENT DOCUMENTS

| | | |
|---|---|---|
| CN | 112212574 A | 1/2021 |
| EP | 3 617 633 A1 | 3/2020 |
| EP | 3 764 044 A1 | 1/2021 |

OTHER PUBLICATIONS

EP Extended European Search Report in European Appln. No. 20206199, dated Apr. 16, 2021, 8 pages.
(Continued)

*Primary Examiner* — Kimberley S Wright
(74) *Attorney, Agent, or Firm* — Birch, Stewart, Kolasch & Birch, LLP

(57) ABSTRACT

A refrigerator includes a cabinet defining a storage chamber, a door configured to open and close the storage chamber, a cooling device configured to cool the storage chamber, an elevation device configured to move a container in the storage chamber upward and downward, a locking device disposed at the elevation device and configured to, based on the elevation device being rotated about a front end of the elevation device in a folded state, lock the elevation device to the folded state and maintain the folded state, and a support plate that is disposed at the elevation device and includes a handle disposed at a rear portion of the support plate.

17 Claims, 23 Drawing Sheets

Related U.S. Application Data continuation of application No. 17/085,705, filed on Oct. 30, 2020, now Pat. No. 11,255,601.

(51) Int. Cl.
*F25D 23/02* (2006.01)
*F25D 25/00* (2006.01)
*F25D 25/04* (2006.01)

(52) U.S. Cl.
CPC ..... *F25D 25/005* (2013.01); *A47B 2088/901* (2017.01); *A47B 2210/175* (2013.01); *F25D 23/021* (2013.01); *F25D 25/04* (2013.01)

(58) Field of Classification Search
CPC ..... A47B 88/90; A47B 2088/901; A47B 2210/17; A47B 2210/175
See application file for complete search history.

(56) References Cited

U.S. PATENT DOCUMENTS 8,282,177 B1 10/2012 Rotter
8,544,391 B2 10/2013 Knox et al.
9,107,494 B2 8/2015 Scheuring et al.
9,377,238 B2 8/2016 Hall et al.
9,644,378 B2 5/2017 Knox et al.
10,465,970 B1 11/2019 Kang et al.
10,568,416 B1 2/2020 Poniatowski
10,598,425 B2 3/2020 Choi et al.
10,598,426 B2 3/2020 Kang
10,598,428 B2 3/2020 Kim
10,627,156 B2 4/2020 Kang
10,712,083 B1 7/2020 Choi
10,724,788 B2 7/2020 Choi
10,767,920 B1 9/2020 Cho
10,876,788 B2 12/2020 Choi
10,900,709 B2 1/2021 Kang
10,921,052 B2 2/2021 Choi
10,932,568 B2 3/2021 Subrahmanya et al.
10,945,524 B2 3/2021 Choi
11,002,478 B2 5/2021 Kang
11,013,322 B2 5/2021 Kim
11,047,619 B2 8/2021 Choi
11,255,601 B2 2/2022 Choi
11,466,928 B2 10/2022 Hong
11,585,594 B2 * 2/2023 Lee ..... F25D 23/028
2003/0201700 A1 10/2003 Cho
2006/0022564 A1 * 2/2006 Oh ..... A47B 67/04 312/402
2006/0037518 A1 * 2/2006 Lopez Alba ..... A47B 9/16 108/145
2006/0042299 A1 * 3/2006 Oh ..... A47B 67/04 62/348
2006/0042302 A1 * 3/2006 Oh ..... A47B 51/00 62/407
2006/0042305 A1 * 3/2006 Oh ..... F25D 25/025 62/407
2006/0043848 A1 * 3/2006 Jeong ..... A47B 67/04 312/310
2006/0103273 A1 * 5/2006 Lee ..... A47B 51/00 312/236
2006/0104756 A1 * 5/2006 Kim ..... A47B 51/00 312/401
2006/0207283 A1 9/2006 Kim et al.
2007/0034125 A1 2/2007 Lo
2008/0018215 A1 * 1/2008 Carden ..... F25D 25/04 312/404
2013/0145972 A1 6/2013 Knox et al.
2014/0135994 A1 5/2014 Bhatt et al.
2014/0265797 A1 9/2014 Scheuring et al.
2014/0265798 A1 9/2014 Watts
2014/0265806 A1 9/2014 Hall et al.
2018/0128540 A1 * 5/2018 Yasaka ..... B66F 7/02
2019/0219324 A1 7/2019 Kang
2019/0292831 A1 9/2019 Choi
2019/0293340 A1 9/2019 Choi
2019/0293341 A1 9/2019 Yeom
2019/0293345 A1 9/2019 Kim
2019/0323763 A1 10/2019 Kang
2019/0346199 A1 11/2019 Choi
2019/0390895 A1 12/2019 Choi
2020/0072533 A1 3/2020 Cho
2020/0072540 A1 3/2020 Kim
2020/0182537 A1 6/2020 Kang
2020/0284502 A1 9/2020 Choi
2021/0007481 A1 1/2021 Kim
2021/0022496 A1 1/2021 Subrahmanya et al.

OTHER PUBLICATIONS

Office Action in Australian Appln. No. 2020270472, dated Nov. 6, 2021, 4 pages.
Office Action in Chinese Application No. 202011124238.7, dated Sep. 5, 2022, 14 pages (with English translation).

* cited by examiner

REFRIGERATOR

CROSS REFERENCE TO RELATED APPLICATION

This application is a Continuation of copending U.S. application Ser. No. 17/576,032, filed Jan. 14, 2022, which is a Continuation of U.S. application Ser. No. 17/085,705, filed Oct. 30, 2020 (now U.S. Pat. No. 11,255,601, issued on Feb. 22, 2022), which claims priority to Korean Patent Application No. 10-2019-0149565, filed on Nov. 20, 2019, the entire contents of all of which are incorporated herein for all purposes by reference.

TECHNICAL FIELD

The present disclosure relates to a refrigerator. More particularly, the present disclosure relates to a refrigerator including a raising/lowering device configured to move a container upward and downward.

BACKGROUND

A refrigerator is a home appliance that can store various foods or beverages for a certain time by cold air generated by circulation of a refrigerant according to a refrigeration cycle.

The refrigerator may be divided into two types of refrigerators, refrigerators that can store storage items a user wants to store regardless of a type of food or drink, and exclusive-use refrigerators that vary in size or function based on types of storage items to be stored.

For example, the exclusive-use refrigerators include a kimchi refrigerator, and a wine refrigerator, and so on.

In some cases, the refrigerator can be classified into various types depending on a door opening and closing method of a storage chamber in a cabinet, such as a swinging door-type refrigerator, a drawer-type refrigerator, and a hybrid-type refrigerator having both doors and drawers.

For example, the hybrid-type refrigerator has a structure in which a swinging door is provided in an upper portion of the cabinet and a drawer is provided in a lower portion thereof.

The drawer provided in the drawer-type refrigerator or the hybrid-type refrigerator may be opened from an inside space of the cabinet in a sliding manner by user's pulling manipulation. In addition, the drawer may be closed by being pushed into the inside space of the cabinet by user's pushing manipulation, thereby allowing an open front portion of the cabinet to be closed.

The drawer can include a front panel and a storage room, and the front panel defines a front surface of the refrigerator and is configured be pulled out/pushed in, thereby allowing the inside space of the cabinet to be opened/closed and the storage room provided in rear of the front panel. The drawer can be received in the inside space of the cabinet. By pulling the front panel, the storage room can be opened from the inside space of the cabinet, and various foods can be stored in and taken out from the storage room.

In some examples, the drawer provided in the drawer-type refrigerator or the hybrid-type refrigerator may be provided in the lower portion of the cabinet. In some case, due to the weight of storage items stored in the storage room of the drawer, the drawer may fall down forward as the drawer is opened.

In some cases, where the drawer is provided at the lower part of the cabinet, a user may bend to take out a container or foods received in the drawer. When the container or the foods are heavy, the heavy container or foods may cause inconvenience or injury to the user.

In some examples, the drawer can be moved upward and downward. For example, a refrigerator may include a lifting mechanism for moving a bin upward and downward in a refrigerating chamber.

In some cases, the lifting mechanism is disposed outside and exposed to the outside of the bin, so the appearance of the structure may be not good. In some cases, accidents may occur when a user is trapped by the lifting mechanism.

The lifting mechanism may be difficult to separate and remove the lifting mechanism from the refrigerating chamber, which may limit the efficient use of space of the storage chamber of the refrigerator.

SUMMARY

The present disclosure describes a refrigerator including a raising/lowering device provided in a drawer and configured to move a container upward and downward. The raising/lowering device can be easily removed the refrigerator.

In addition, the present disclosure describes a refrigerator including a raising/lowering device that has a scissor type link structure and can be removed to the outside in a folded state.

For example, a user can hold a handle provided at a rear end of the raising/lowering device to remove the device in the folded state. An anti-loosening or locking device can automatically operate to lock the raising/lowering device to the folded state and maintain the folded state of the raising/lowering device.

According to one aspect of the subject matter, a refrigerator includes a cabinet that defines a storage chamber therein and a front opening in communication with the storage chamber, where the storage chamber is configured to receive a container, at least one door configured to open and close at least a portion of the front opening of the cabinet, a cooling device configured to cool the storage chamber, and an elevation device configured to be disposed at the storage chamber and to move the container upward and downward, where the elevation device is configured to fold toward a bottom surface of the storage chamber and to unfold in a direction away from the bottom surface of the storage chamber. The refrigerator further includes a locking device disposed at the elevation device and configured to, based on the elevation device being rotated about a front end of the elevation device in a folded state in the storage chamber, lock the elevation device to the folded state and maintain the folded state, and a support plate that is disposed at an upper end of the elevation device and supports a lower end of the container, where the support plate includes a handle disposed at a rear portion of the support plate and configured to be grasped by a user.

Implementations according to this aspect may include one or more of the following features. For example, the support plate can include a plurality of edges that protrude upward from an upper surface of the support plate to define an inner part that is surrounded by the edges and configured to receive the lower end of the container. In some examples, the plurality of edges of the support plate include a front edge that protrudes upward from a front end of the upper surface of the support plate, a pair of side edges that protrudes upward from sides of the upper surface of the support plate, and a rear edge that protrudes upward from a rear end of the upper surface of the support plate.

In some examples, the handle is disposed at the rear edge. In some examples, the handle includes a pair of handles that are disposed at lateral ends of the rear edge and face the pair of side edges. In some examples, the handle defines a groove that is recessed rearward from a front side of the rear edge. In some examples, the handle defines a handle hole at a lower side of the handle, the handle extending vertically along the handle hole with respect to the upper surface of the support plate.

In some implementations, the refrigerator includes a cover plate configured to cover the handle hole, where the cover plate can be coupled to and separated from the support plate. In some examples, the cover plate can be coupled to the support plate by a fastening bolt. In some examples, the support plate further includes a bolt fastening part disposed at the rear edge of the support plate and configured to receive the fastening bolt.

In some examples, the bolt fastening part extends vertically with respect to the upper surface of the support plate, and a vertical length of the bolt fastening part corresponds to a vertical length of the handle. In some examples, the cover plate includes a body part configured to cover the handle hole, and an edge part that protrudes outward from a lower surface of the body part. The edge part can be configured to surround the handle hole and to contact the lower side of the handle.

In some implementations, the elevation device includes an upper frame, a lower frame disposed vertically below the upper frame, and a scissor assembly disposed between the upper frame and the lower frame. In some implementations, the locking device includes a lower locking device disposed at the lower frame, and an upper locking device disposed at the upper frame and configured to couple to the lower locking device.

In some implementations, the lower locking device includes a casing disposed at a middle portion of the lower frame, a lower hook configured to move in the casing, and a force applying member configured to apply force to the lower hook. In some examples, the lower hook includes a lower hook body that extends vertically toward the upper frame, a support end that is disposed at a lower end of the lower hook body and supports the lower hook body, and a lower hook end that protrudes from an upper end of the lower hook body and is configured to couple to the upper locking device.

In some implementations, the casing defines a hook hole at an upper surface of the casing, and the lower hook body vertically passes through the hook hole. In some examples, a length of the hook hole in a front-rear direction is greater than a thickness of the lower hook body in the front-rear direction, and the lower hook body is configured to move in the hook hole in the front-rear direction.

In some implementations, the support end extends from the lower end of the lower hook body in the front-rear direction, and includes an end part that extends vertically upward from a rear portion of the support end and that is configured to move in the casing in the front-rear direction. The force applying member can be disposed in the casing and configured to provide electric force to the lower hook to thereby push or pull the lower hook to a side of the casing.

In some implementations, where the elevation device is removed in the folded state, the removing operation of the elevation device can be simple and convenient, compared to when the elevation device is removed to the outside with the elevation device unfolded.

In some examples, when a user holds and lifts the elevation device by a hand, the locking device can automatically operate to lock and maintain the elevation device in the folded state, where the elevation device can, without an additional manipulation, be removed to the outside in the folded state.

In some implementations, while the elevation device is mounted in the storage room of the refrigerator, the elevation device is unlocked and scissor side connection parts are received into connection holes of the storage room. When the rear end of the elevation device is moved upward, the locking device can automatically restrict unfolding of the elevation device, and each of the scissor side connection parts of a front end of the elevation device can be naturally removed from each of the connection holes of the storage room, so that the elevation device is easily removed from the storage room.

In some implementations, the handle can be provided only on the rear end part of the elevation device, and a user can hold the handle of the rear end part to lift up the elevation device of the storage room. Accordingly, spreading of the elevation device, which can occur when the user lifts the elevation device by holding the front end part or a middle part thereof, can be avoided, where accidents can be reduced and convenience of use can be improved.

In some implementations, the locking device can maintain the folded state of the elevation device disposed in the storage room. The folding of the elevation device can be automatically released by a spacing protrusion of the storage room, where the upward/downward movement of the elevation device can be performed. In some examples, when the handle of the rear end part of the elevation device is lifted up, the locking device can lock the elevation device in the folded state. Accordingly, usability can improved by the simple structure.

DETAILED DESCRIPTION

Hereinbelow, one or more implementations of a refrigerator will be described.

Figure 1:
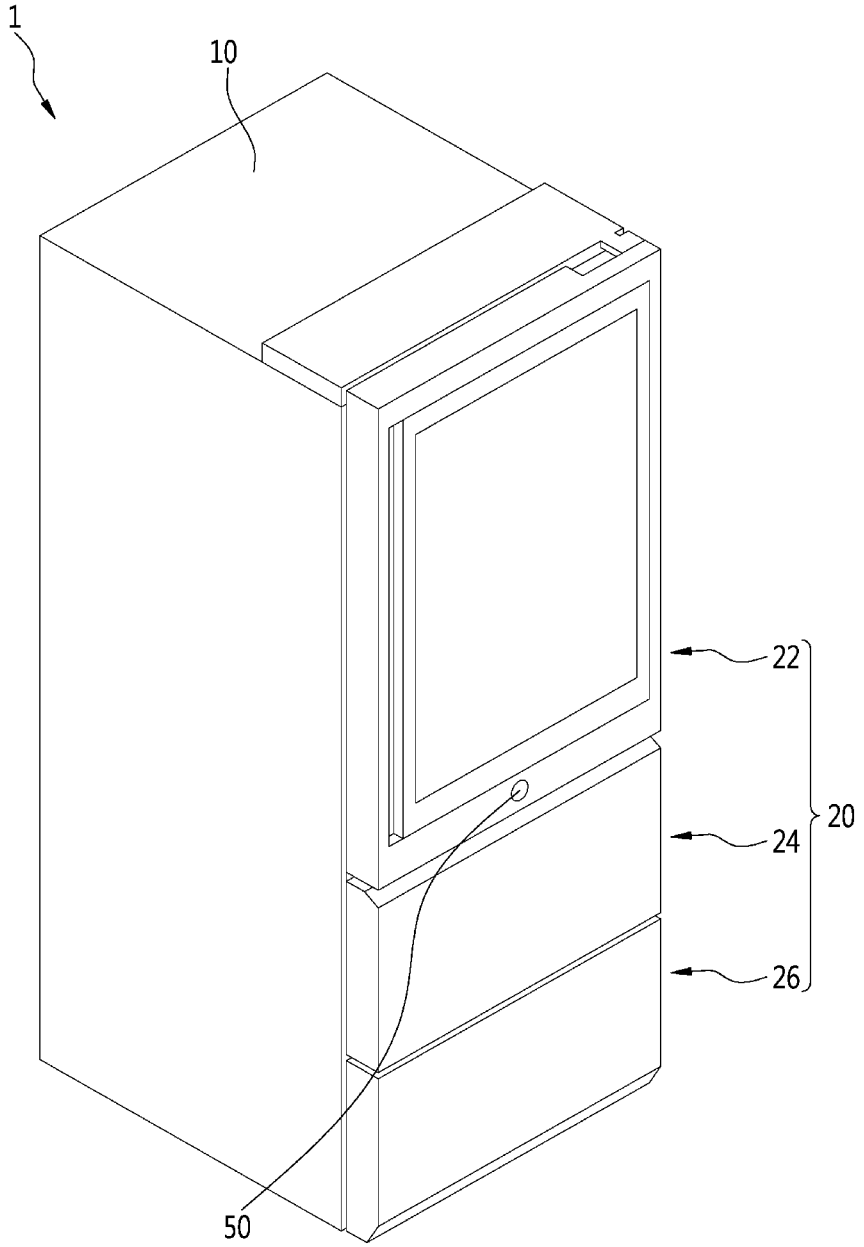
FIG. 1 is a perspective view illustrating an example of a refrigerator.
Figure 2:
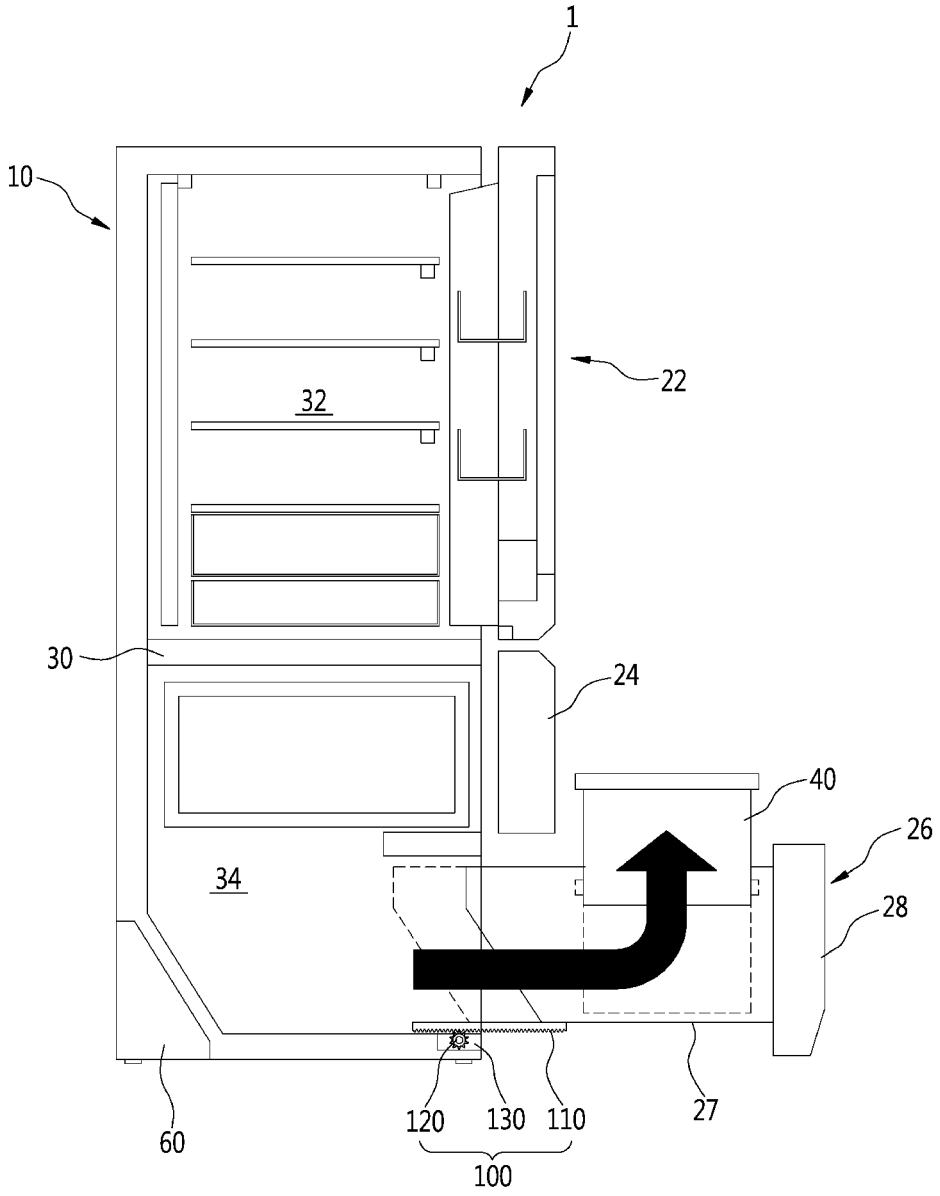
FIG. 2 is a sectional view illustrating the refrigerator an example container moved upward by a raising/lowering device.

FIG. 1 is a perspective view of an example of a refrigerator, and FIG. 2 is a sectional view of the refrigerator illustrating an example of a container moved upward by a raising/lowering device.

As illustrated in these drawings, the refrigerator 1 can have a hexahedron shape with a predetermined volume and define a storage chamber for storing food therein.

For example, the refrigerator 1 can include a cabinet 10 that defines a space including the storage chamber therein and an open surface thereof (a front thereof), and at least one door 20 covering the open surface (the front) of the cabinet 10. A cooling device can be provided in the refrigerator 1 to cool the storage chamber. For example, the cooling device can include a compressor, an evaporator, a condenser, and an expansion valve.

Referring to FIG. 1, the cabinet 10 of the refrigerator 1 can be configured such that the front thereof is open, and the door 20 covers the front of the cabinet 10.

An inner part of the cabinet 10 can be partitioned into multiple spaces. That is, a space of the storage chamber provided in the cabinet 10 can be divided by at least one inner wall 30. In some examples, as shown in the present disclosure, the space can be divided into upper and lower spaces by the parallel inner wall 30.

In some implementations, the cabinet 10 can include an upper space 32 on an upper side thereof and a lower space 34 provided on a lower side thereof relative to the inner wall 30. In some examples, the upper space 32 can be used as a refrigerating compartment and the lower space 34 is used as a freezer compartment.

In some examples, a role of the upper space 32 and a role of the lower space 34 can be exchanged, all of the upper space 32 and the lower space 34 can be used as a refrigerating compartment, or all of the upper space 32 and the lower space 34 can be used as a freezer. Accordingly, the upper space 32 and the lower space 34 can be designed as a freezer or a refrigerating compartment, and can be designed for other purposes.

The door 20 can be provided as a swinging type door or a drawer moving forward and backward.

In some implementations, the upper space 32 can include a swinging door 22, and the lower space 34 includes drawers 24 and 26.

In addition, the lower space 34 can be divided into two inner spaces, and the two drawers 24 and 26 can be arranged horizontally in the two spaces, respectively. Accordingly, of the drawers 24 and 26, the drawer covering an upper space can be an upper drawer 24 and the drawer covering a lower space can be a lower drawer 26.

In some examples, as for the configuration of the door 20 described above, the number of the doors can be variously changed depending on an inner space of the cabinet 10, and the doors can be provided entirely as the swinging doors 22 or entirely as the drawers 24 and 26.

The drawers 24 and 26 can be automatically moved forward or backward by an opening/closing device 100. In some examples, the drawers 24 and 26 can be further provided with the raising/lowering device 200, which will be described hereinbelow, such that the container 40 provided therein is automatically moved upward and downward.

Furthermore, a portion or all of the drawers 24 and 26 can automatically move forward and backward or upward and downward. That is, all of the upper drawer 24 and the lower drawer 26 can automatically move forward and backward, or the upper drawer 24 can manually move forward and backward and the lower drawer 26 can be configured to automatically move forward and backward.

In the present disclosure, the upper drawer 24 can manually move forward and backward, and only the lower drawer 26 can be automatically moved forward and backward by the opening/closing device 100. The container 40 can be automatically moved upward and downward by the raising/lowering device 200, which will be described hereinbelow.

The opening/closing device 100 can be provided to have a rack-pinion structure and forces the drawer 26 to move forward and backward (to opposite sides of FIG. 2).

In some implementations, a rack 110 can be provided on a lower surface of the lower drawer 26 and the pinion 120 meshing with the rack 110 by gear engagement can be rotatably provided in a bottom surface of the refrigerator 1.

In addition, a motor 130 can be provided on a bottom surface of the refrigerator 1 and configured to supply a rotational force to the pinion 120.

Accordingly, when the motor 130 generates the rotational force by using power supplied from the outside, the pinion 120 can be rotated clockwise or counterclockwise by the rotational force. Accordingly, the lower drawer 26 combined with the rack 110 can move forward and backward (to the opposite sides of FIG. 2).

The rack 110 can be a double rack. That is, to allow the lower drawer 26 to be sufficiently opened to the outside, the rack 110 can be configured as a double rack having at least two racks.

In some examples, the refrigerator 1 can include a button 50 to control the lower drawer 26 such that the lower drawer 26 is automatically opened or closed. That is, as illustrated in FIG. 1, the button 50 can be provided on a front surface of a lower end of the swinging door 22 in the refrigerator 1, and the lower drawer 26 can be opened or closed by a user pressing the button.

In some examples, the button 50 can be provided on a front surface of the lower drawer 26 or can be provided on various parts such as a front surface or side surface of the refrigerator 1.

The drawer 26 can include a storage room 27 having a containing space or receiving the container 40 therein and a front panel 28 provided at a front (a right side of FIG. 2) of the storage room 27 to be integrated therewith so as to constitute an outer surface of the front.

In addition, the refrigerator 1 can include a machine room 60 provided at a lower rear side thereof. A compressor and a condenser performing a refrigeration cycle can be arranged in the machine room 60.

Figure 3:
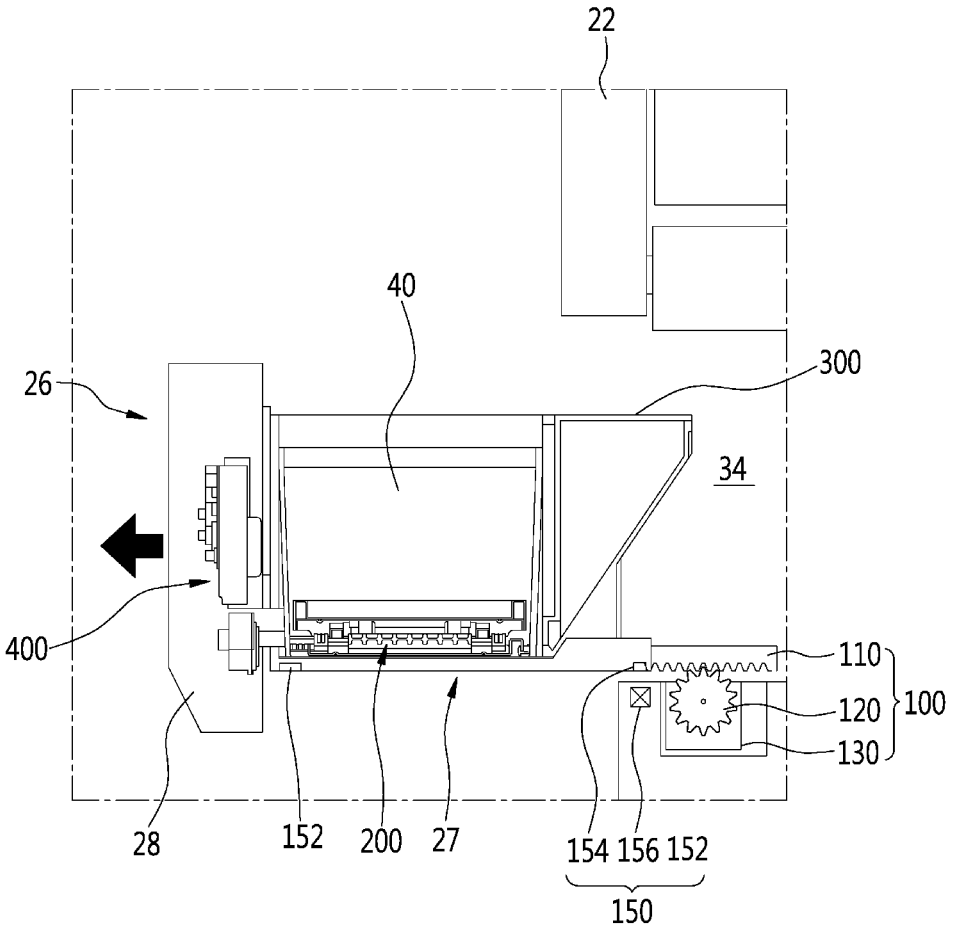
FIG. 3 is a partial sectional view illustrating an example of a lower drawer that is moved forward.
Figure 4:
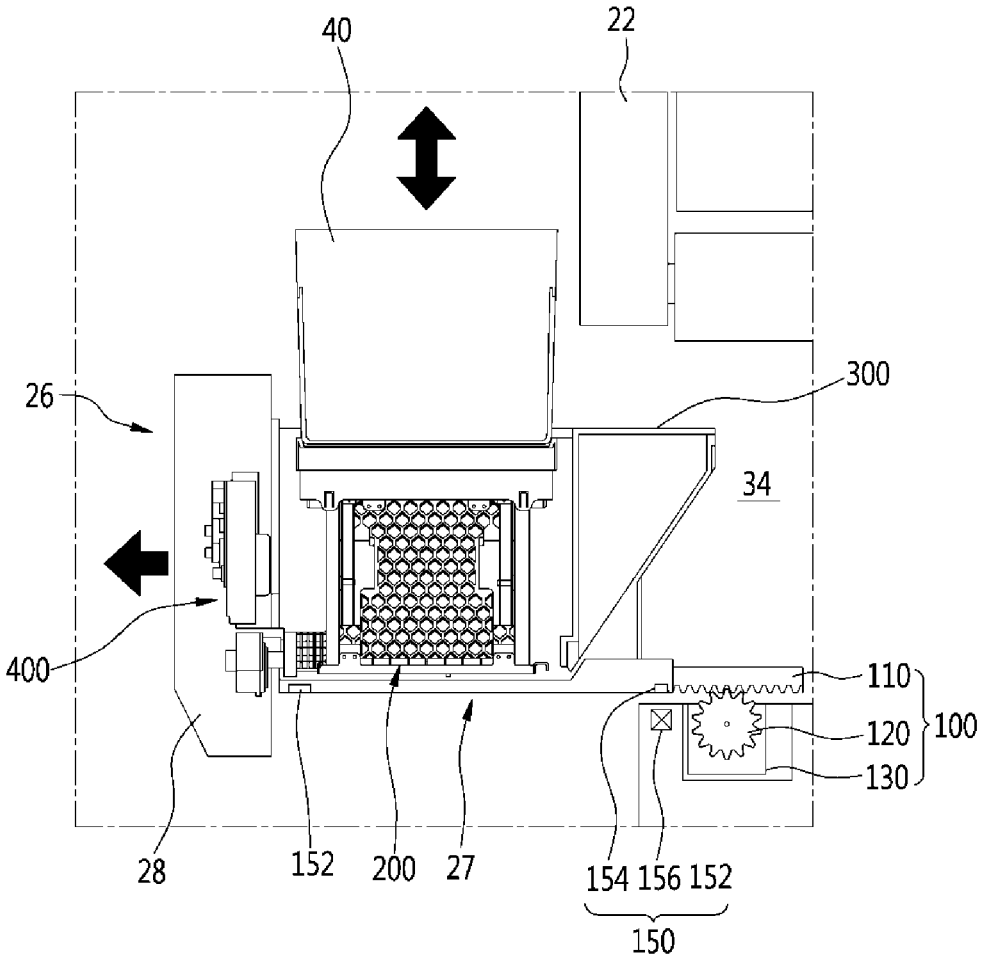
FIG. 4 is a partial sectional view illustrating the container that is moved upward by the raising/lowering device.

In FIGS. 3 and 4, a state of the lower drawer 26 of the drawers 24 and 26, which is completely opened forward (to a left side of FIG. 3), is illustrated. FIG. 3 illustrates the lower drawer 26 that is completely opened forward and the raising/lowering device 200 that has not operated yet. FIG. 4 illustrates the lower drawer 26 that is completely opened forward and the container 40 moved upward by the raising/lowering device 200.

As illustrated in these drawings, the lower drawer 26 can be moved forward (to a left side of FIGS. 3 and 4) by a forward moving control by the button 50. In this case, the forward movement of the lower drawer 26 can be performed by the opening/closing device 100.

In some examples, a lower drawer 26 may not be opened and closed by a manual manipulation of a user, and, for example, the lower drawer 26 can be automatically opened and closed by a manipulation of a user pressing the button 50. That is, when a user presses the button 50, the rotational force can be generated by the motor 130, and the pinion 120 can be rotated counterclockwise by the rotational force.

Accordingly, when the pinion 120 rotates counterclockwise, the rack 110 meshing with the pinion 120 can be moved to the left, and an entirety of the lower drawer 26 to which the rack 110 is fixed can move to the left and be open.

For example, a distance which the lower drawer 26 moves to be open to the left can be a length allowing the container 40 received into the storage room 27 to be completely exposed to the outside from the front surface of the refrigerator 1. That is, the lower drawer 26 can be sufficiently opened such that a user takes out the container 40, or takes out or stores food in the container 40.

In addition, the container 40 can be moved upward by the raising/lowering device 200 provided at a lower side of the container 40. Even in this case, the lower drawer 26 can be sufficiently opened such that the container 40 does not hit the front surface of the refrigerator 1, that is, a lower end of a front surface of the upper drawer 24.

Accordingly, to allow the lower drawer 26 to be sufficiently removed forward, the structure having the pinion 120 and the rack 110 can include the double rack structure.

Whether the lower drawer 26 is sufficiently open can be determined by an open/close detecting device 150.

The open/close detecting device 150 can detect whether the lower drawer 26 is sufficiently open to the outside (the left side of FIG. 3), and, for example, include permanent magnets 152 and 154, and a detection sensor 156.

The permanent magnets 152 and 154 can be fixed to a left end (a front end of the lower surface of the lower drawer) of the lower surface of the lower drawer 26 and a right end thereof (a rear end thereof), respectively, and the detection sensor 156 can be fixed to a front end part of the bottom surface of the refrigerator 1.

In some implementations, as illustrated in FIG. 3, the permanent magnets 152 and 154 can include a front end magnet 152 provided at the left end (the front end) of the lower surface of the lower drawer 26 and a rear end magnet 154 provided at the right end (the rear end) of the lower drawer 26.

Accordingly, when the front end magnet 152 is brought close to the detection sensor 156, the lower drawer 26 can be recognized as being closed, and when the rear end magnet 154 is brought close to the detection sensor 156, the lower drawer 26 can be recognized as being opened.

The detection sensor 156 can be various sensors such as a Hall sensor or a lead switch.

The components of the open/close detecting device 150 can be installed at positions contrary to the above-described positions. That is, the permanent magnets 152 and 154 can be installed at the bottom surface of the refrigerator 1 and the detection sensor 156 can be installed at the lower drawer 26.

The container 40 of a shape of a rectangular container having an open upper part can be received in an inner space of the storage room 27 and the container 40 can be moved upward and downward by the raising/lowering device 200. Accordingly, the raising/lowering device 200 can be installed under the container 40 so as to support the container 40.

In some examples, a rear side of the inner space of the storage room 27 (right sides of FIGS. 3 and 4) can be covered by an inner cover 300.

As illustrated in FIGS. 3 and 4, the inner cover 300 can be installed to have a section of an "L" shape as a whole and cover the remaining rear end space of the inner space of the storage room 27 except for a space corresponding to an occupying space of the container 40 in the inner space thereof.

Accordingly, the rear end space of the storage room 27 can be covered by the inner cover 300, whereby a neat appearance can be provided to a user and a hand of the user can be prevented from being trapped therein.

As illustrated in FIG. 3, when the forward movement of the lower drawer 26 is completed, then the raising/lowering device 200 can operate and the container 40 can be moved upward. That is, the raising/lowering device 200 positioned under the container 40 can operate and the container 40 can be lifted to an upper side of the storage room 27. For example, FIG. 4 illustrates an example state of the container 40 that has completely moved upward by the raising/lowering device.

A driving device 400 can be provided in the front panel 28 of the lower drawer 26 and control operation of the raising/lowering device 200. That is, a vertical height of the raising/lowering device 200 can be changed such that a distance between an upper surface and a lower surface of the raising/lowering device increases or decreases. Accordingly, the raising/lowering device 200 can move the container 40 at an upper side thereof upward and downward, and the operation of the raising/lowering device 200 can be controlled by the driving device 400.

The raising/lowering device 200 can be folded or unfolded in an upper end and lower end thereof, and when the raising/lowering device is not used, volume thereof can be minimized, so the raising/lowering device 200 can be received in the storage room 27. That is, the raising/lowering device 200 can be configured to have a scissor type link structure in which the height of the raising/lowering device 200 is minimized during the folding of the raising/lowering device 200 and the height of the raising/lowering device 200 is maximized during the unfolding of the raising/lowering device 200. For example, the raising/lowering device 200 can include a plurality of links or bars that are connected to one another and configured to rotate relative to one another to fold and unfold. In some examples, the raising/lowering device 200 may be referred to as a lifting mechanism, an elevation device, a folding device, or the like.

When a folded state of the raising/lowering device 200 is detected while the lower drawer 26 is completely removed and the raising/lowering device 200 is also completely lowered, the driving device 400 can operate and allow the raising/lowering device 200 to unfold.

In some implementations, an additional raising/lowering detection device can be provided in the front panel 28, in the driving device 400, or in an area adjacent thereto and detect whether the raising/lowering device 200 is folded or unfolded. In some examples, due to the upward or downward moving position of the container 40 detected, the folding or unfolding of the raising/lowering device 200 can also be determined.

Figure 5:
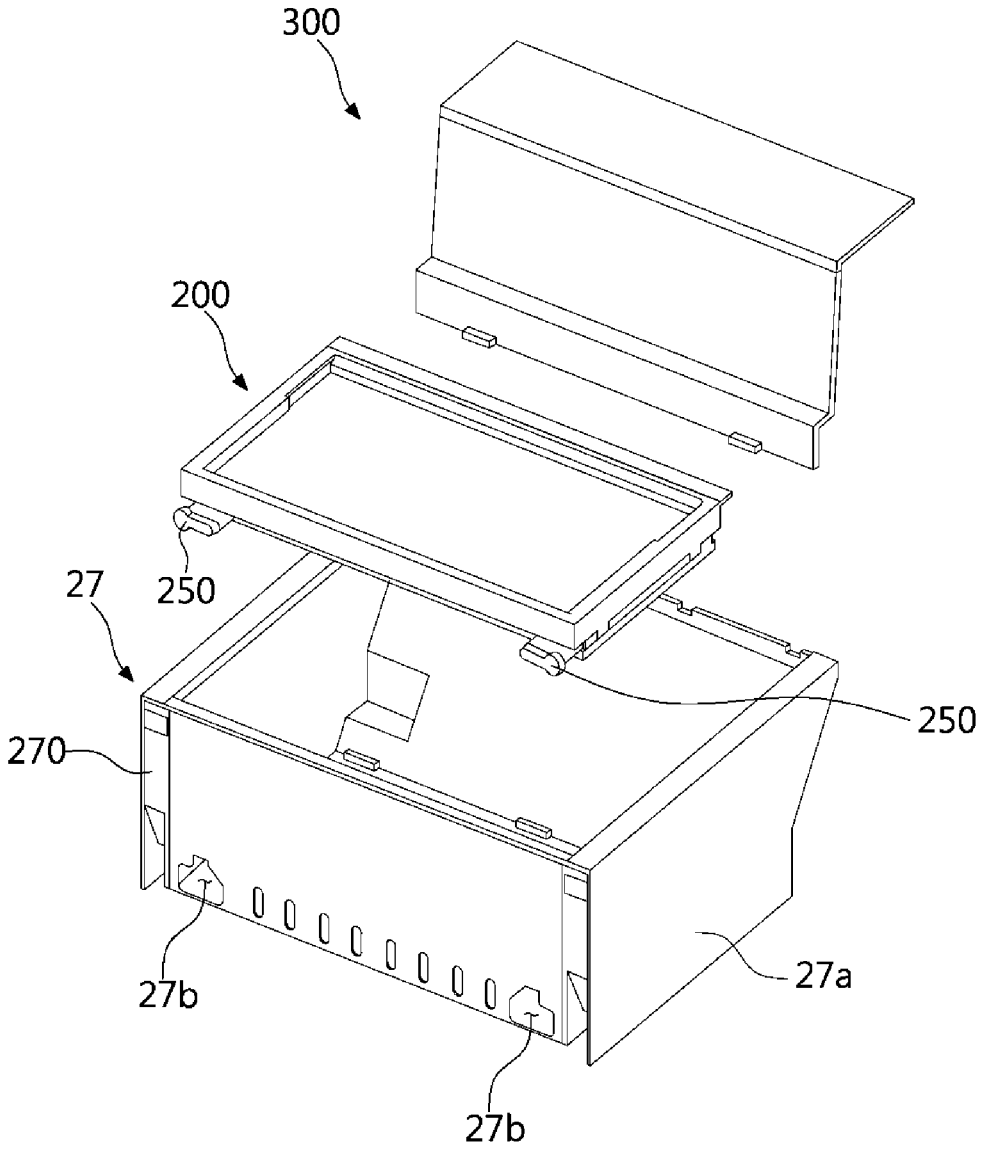
FIG. 5 is an exploded perspective view illustrating example components of a storage room of the lower drawer.
Figure 6:
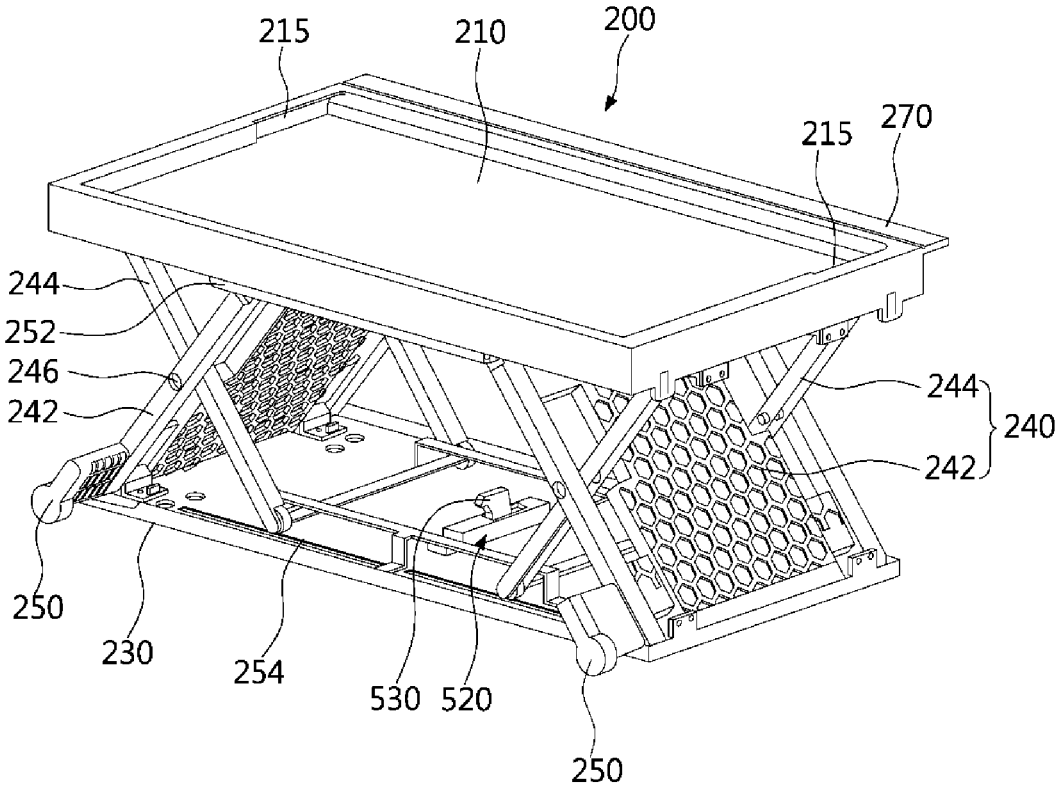
FIG. 6 is a perspective view illustrating the raising/lowering device.
Figure 7:
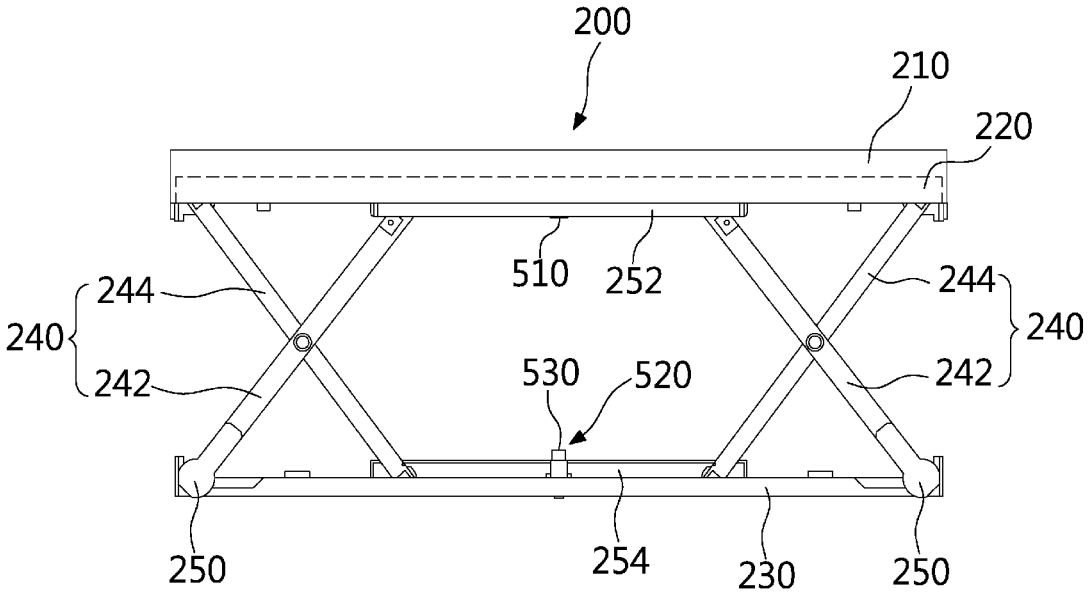
FIG. 7 is a front view illustrating the raising/lowering device.
Figure 8:
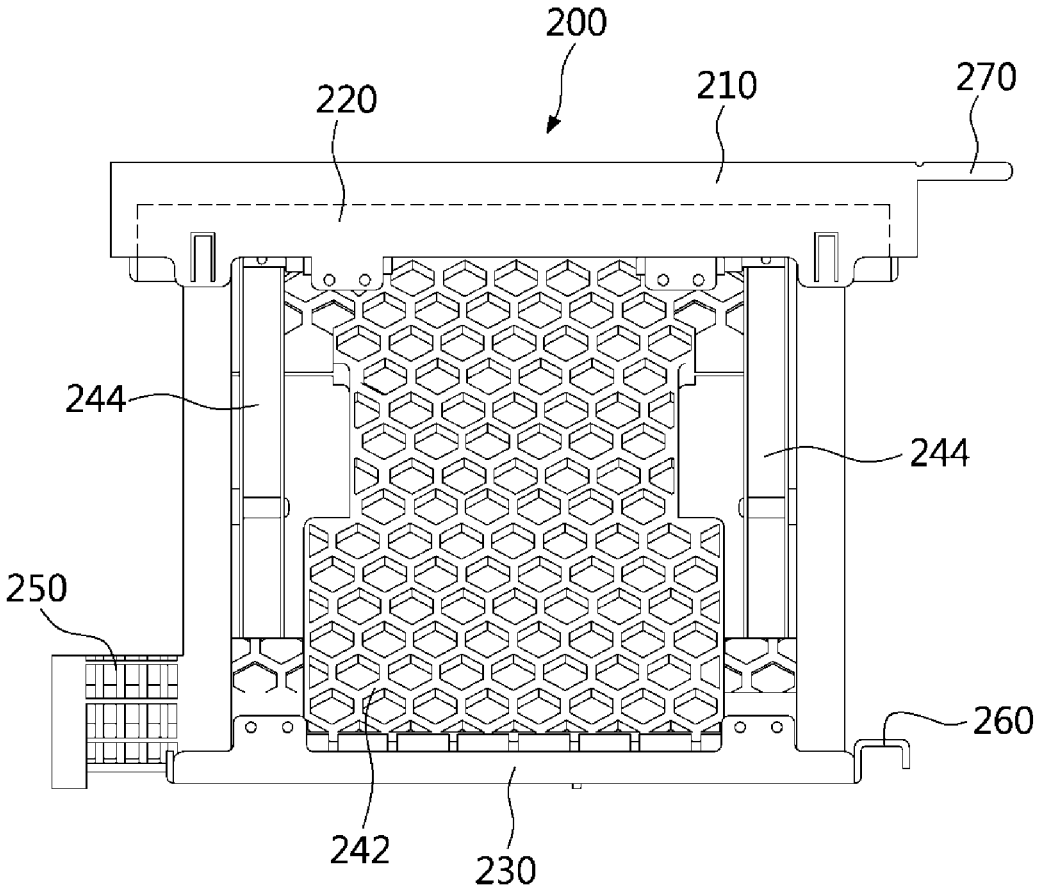
FIG. 8 is a right side view illustrating the raising/lowering device.
Figure 9:
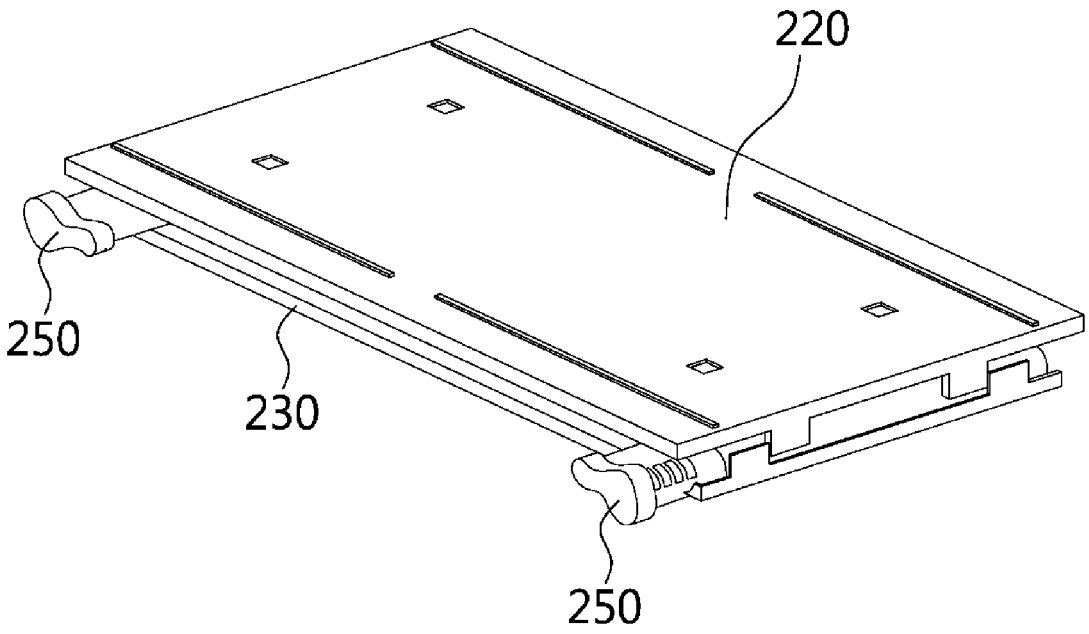
FIG. 9 is a perspective view illustrating the raising/lowering device without a support plate.

In FIG. 5, an exploded perspective view of components provided in the storage room 27 is illustrated.

As illustrated in FIG. 5, the storage room 27 can have the containing space of a predetermined size therein so as to constitute an outer surface thereof. The storage room 27 can be provided with the raising/lowering device 200 therein such that the container 40 or food is moved upward and downward.

In addition, the inner cover 300 can be further provided in the storage room 27 so as to cover a rear end part of an inner part of the storage room 27 and to partition the inner space of the storage room 27.

The storage room 27 can be formed of plastic materials by injection molding to have an entire shape thereof. The storage room 27 can have a shape of a basket having an open upper surface to have a space therein to allow food to be stored.

In some examples, a rear surface of the storage room 27 can be an inclined surface so that the storage room 27 can avoid interference with the machine room 60 provided at the lower rear side of the refrigerator 1.

An outer side plate 27*a* can be provided on each of opposite surfaces of outer sides of the storage room 27. The outer side plate 27*a* can be installed on each of the opposite surfaces of the storage room 27 to constitute outer surfaces thereof.

Furthermore, the outer side plate 27*a* can also function such that components such as a door frame mounted to each of opposite sides of a drawer body 38 and the rack 110 constituting the opening/closing device 100 are not exposed to the outside.

The inner cover 300 can be provided to divide the inner part of the storage room 27 into a front space and a rear space.

Accordingly, the inner cover 300 can cover the rear space of the inner space of the storage room 27 so as to allow only the inner space of a front of the storage room to be exposed to the outside. That is, in the inner part of the storage room 27, only the front space at which the raising/lowering device 200 is arranged can be exposed to the outside and the rear space can be covered by the inner cover 300.

The inner cover 300 can be made of a metal material as the outer side plate 27*a*. This is to allow a user to feel the texture of metal and create aesthetic qualities and have rigidity since the inner cover 300 is a part seen during the forward movement of the lower drawer 26 by the user.

A front surface and side surfaces of the storage room 27 can also be made of a metal material. Accordingly, when each part of the storage room 27 is made of the metal material, inner sides of the containing space of the storage room 27 can entirely have the feel of metal, food stored therein can be stored to be entirely and evenly cold, and visually aesthetic qualities can be created for a user.

The raising/lowering device 200 can sit in the inner part of the storage room 27.

The raising/lowering device 200 can have a structure of being vertically moved upward and downward by the driving device 400 connected thereto, which will be described, and in some examples, opposite sides of the raising/lowering device can move upward and downward at the same rate To combine the raising/lowering device 200 with the driving device 400, a connection hole 27*b* can be provided at each of lower opposite sides of the front surface of the storage room 27 by being formed therethrough in a front to rear direction of the front surface.

The connection hole 27*b* can be a part into which the scissor side connection part 250 provided at the front end of the raising/lowering device 200 is inserted to be received therein. Accordingly, a radius of the connection hole 27*b* can be configured to be the same as or larger than a radius of the scissor side connection part 250.

In FIGS. 6 to 10, the configuration of the raising/lowering device 200 is illustrated. That is, in FIG. 6, a perspective view of configuration of the raising/lowering device is illustrated, and in FIGS. 7 and 8, a front view and a right side view of the raising/lowering device 200 are illustrated. In addition, in FIG. 9, a perspective view of a state of the raising/lowering device 200 from which a support plate 210 is removed is illustrated, and in FIG. 10, a right side sectional view of the raising/lowering device 200 is illustrated. Furthermore, in FIG. 11, a side view of a state at which an upper locking device 510 is automatically engaged with a lower locking device 520 due to lowering of an upper frame 220 of the raising/lowering device 200 is illustrated.

As illustrated in the drawings, the raising/lowering device 200, which is configured to be a scissor type, can be folded when the raising/lowering device is lowered and can be unfolded when the raising/lowering device is raised such that the container 40 or food seated on the upper surface thereof is moved upward and downward.

In addition, the raising/lowering device 200 can be further provided with the support plate 210 thereon. That is, as illustrated in the accompanying drawings, the support plate 210 can be further provided on an upper end of the raising/lowering device 200 to allow the container 40 laid on an upper side thereof to be efficiently seated.

The support plate 210, which constitutes an outer surface of the upper surface of the raising/lowering device 200, can be configured to have a predetermined thickness and can be made of a metal such as a stainless material to be aesthetic, and can be configured such that an inner part of the support plate is depressed so as to allow the container 40 to be efficiently seated and fixed.

The raising/lowering device 200 can be provided on an inner bottom of the storage room 27 and, in some examples, can be removably provided at an inner side of the storage room 27.

The raising/lowering device 200 can include the upper frame 220 provided at the upper side thereof, a lower frame 230 provided under the upper frame 220, and a pair of scissor assemblies 240 arranged between the upper frame 220 and the lower frame 230.

As illustrated in the drawings, the upper frame 220 can be configured to have a rectangular frame shape, and the support plate 210 can sit on and be fixed to an upper surface of the upper frame 220.

The upper frame 220 of the raising/lowering device 200 can move in upward and downward directions and substantially support food or the container 40 together with the support plate 210.

The upper frame 220 can be configured to have a metal plate shape, and edges thereof can be partially bent downward. Accordingly, the upper frame 220 can be configured to define a space to house each of the scissor assemblies 240 in cooperation with the lower frame 230.

The lower frame 230 can be provided under the upper frame 220 and sits on a bottom surface of the storage room 27. Furthermore, the lower frame 230 can be configured to have a shape corresponding to a shape of the upper frame 220.

The lower frame 230 can also be configured to have a metal plate shape as the upper frame 220, and edges thereof can be bent upward. Accordingly, the lower frame 230 can be configured to define the space to house each of the scissor assemblies 240 together with the upper frame 220.

The raising/lowering device 200 can be unfolded or folded upward and downward by the scissor assemblies 240. Accordingly, a locking device 500 can allow the raising/lowering device 200 to be folded.

The locking device 500 can allow the lower frame 230 and the upper frame 220 to be brought close to each other to vertically fold the raising/lowering device 200 such that a vertical length of the locking device is minimized.

Accordingly, the locking device 500 can include the upper locking device 510 provided in the upper frame 220 and the lower locking device 520 provided in the lower frame 230.

In some implementations, the lower locking device 520 can be provided at a middle of the lower frame 230. The lower locking device 520 can function to allow the upper frame 220 and the lower frame 230 to be not randomly separated from each other and to be in a state of restricting each other when the raising/lowering device 200 is removed from the storage room. That is, the lower locking device 520 can allow the scissor assemblies 240 to maintain the folded state thereof without unfolding.

The lower locking device 520 can include a locking device casing 522 fixed to the middle of the lower frame 230, a lower hook 530 moving in the locking device casing 522, and a force applying member 524 applying a unidirectional force to the lower hook 530.

In some implementations, the lower locking device 520 can be provided at the middle of an upper surface of the lower frame 230 by protruding upward therefrom.

Figure 10:
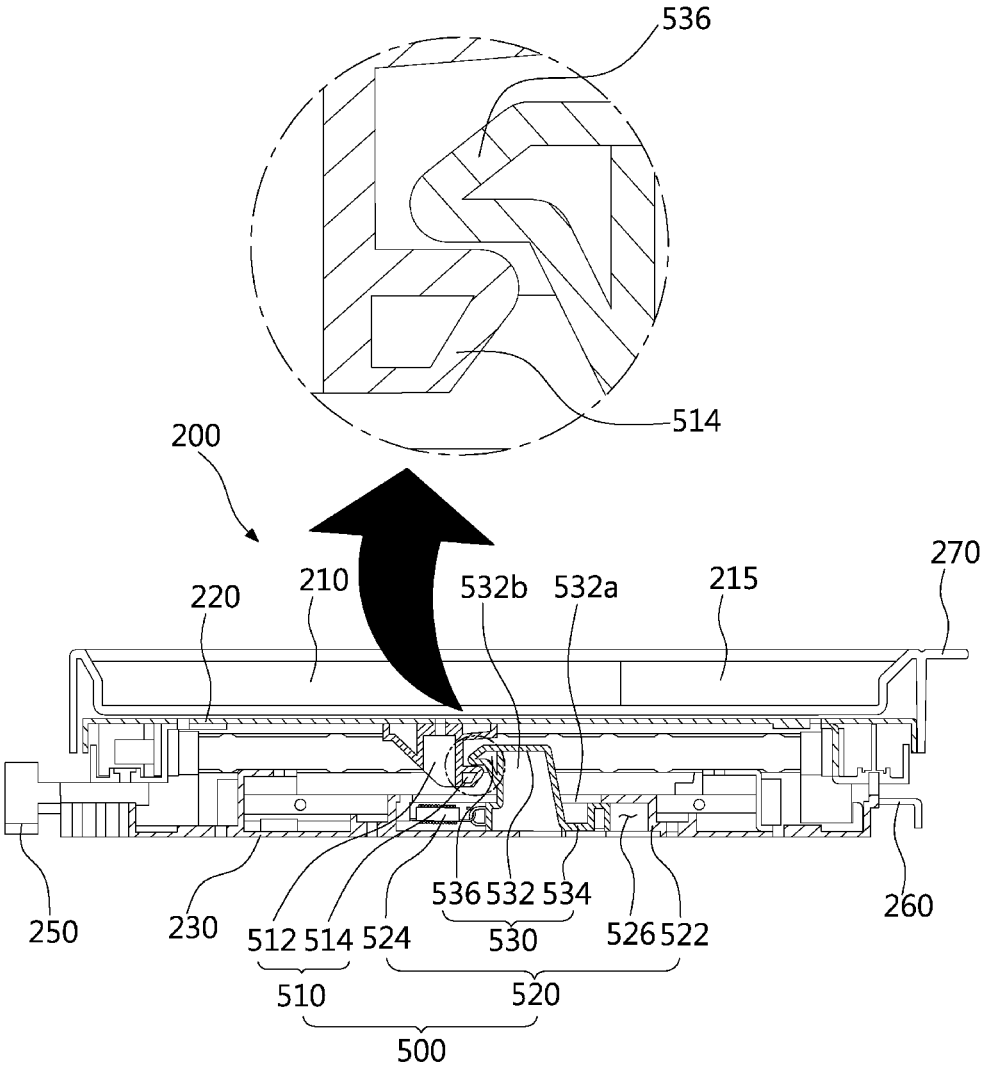
FIG. 10 is a right side sectional view illustrating the raising/lowering device.

In addition, as illustrated in FIG. 10, the locking device casing 522 can be configured to have a predetermined front to rear length (to opposite sides of FIG. 10) and a hook space 526 having volume of a predetermined size can be provided in the locking device casing 522.

The lower hook 530 can include a lower hook body 532 having a predetermined vertical height, a support end 534 provided at a lower end of the lower hook body 532 to support the lower hook body 532, and a lower hook end 536 protruding by extending forward from an upper end of the lower hook body 532.

The lower hook body 532 can be configured to have the predetermined vertical height and a hook hole 532*a* can be provided in an upper surface of the locking device casing 522 by being vertically formed therethrough. That is, the hook hole 532*a* having a predetermined front to rear length can be provided in the upper surface of the locking device casing 522 by being vertically formed therethrough, and the lower hook body 532 can be arranged by vertically passing through the hook hole 532*a*.

The lower hook body 532 can be configured such that an inner part thereof is hollow and a lower part thereof is open. That is, the inner part of the lower hook body 532 can be hollow and the lower part thereof can be open to have a protrusion groove 532*b*. A spacing protrusion 27*c*, which will be describe hereinbelow, can be received in the protrusion groove 532*b*.

In some implementations, a front to rear thickness of the lower hook body 532 can be configured to gradually decrease toward the upper end of the lower hook body. In some examples, as illustrated in FIG. 10, at least a rear surface (a right surface of the lower hook body of FIG. 10) of the lower hook body 532 can be gradually inclined so as to be positioned at a further rear side toward a lower side thereof.

The front to rear length of the hook hole 532*a* can be configured to have a size larger than a size of the thickness of the lower hook body 532 provided to pass through the hook hole 532*a*. Accordingly, the lower hook body 532 can be allowed to move a predetermined distance forward and backward while the lower hook body 532 is received in the hook hole 532*a*.

As illustrated in FIG. 10, the support end 534 can be configured to extend forward and backward (to opposite sides of FIG. 10) at a lower end of the lower hook body 532 and vertically extend therefrom and is a part moving forward and backward (to the opposite sides of FIG. 10) in the locking device casing 522.

In some examples, the support end 534 can move forward and backward (to the opposite sides of FIG. 10) without having interference in the locking device casing 522. That is, a width between the opposite sides of the support end 534 can be formed to be at least 0.5 mm smaller than a width between the opposite sides of the inner part of the locking device casing 522.

The lower hook end 536 can be provided to protrude by a predetermined portion by perpendicularly bending to a front (a left side of FIG. 10) of the lower hook body 532 from the upper end thereof and have a shape corresponding to a shape of an upper hook end 514 of the upper locking device 510, which will be described hereinbelow.

In some implementations, a lower surface of the lower hook end 536 can be horizontal and a front surface thereof can be an inclined surface. That is, as illustrated in FIG. 10, the front surface of the lower hook end 536 can be the inclined surface, a height of which gradually decreases toward the front thereof.

The force applying member 524 can be provided in the locking device casing 522 and function to pull the lower hook 530 forward (to the left side of FIG. 10). In some implementations, the force applying member 524 can be configured as a tension spring and functions to pull the lower hook 530 forward by tensile elasticity. In some examples, the force applying member 524 can be other types of actuators configured to apply force to the lower hook 530.

A front of the force applying member 524 can be connected to a front surface of an inner side of the locking device casing 522 and a rear end of the force applying member can be connected to a front end of the support end 534.

In some examples, the force applying member 524 can be made of various materials as long as the force applying member has function of pushing or pulling the lower hook 530 forward by the elasticity. For example, the force applying member 524 can be provided as an elastic spring and installed at a rear side of the support end 534 to push the lower hook 530 forward by an elastic force.

The upper frame 220 can include the upper locking device 510 provided on a middle portion of a lower surface of the upper frame.

As illustrated in the accompanying drawings, the upper locking device 510 can be provided by protruding downward from the lower surface of the upper frame 220 and have a shape corresponding to a shape of the lower hook 530 such that the upper locking device and the lower hook are engaged with each other.

For example, the shape of the upper locking device 510 can be formed to be symmetrical to the shape of the lower hook 530, and include an upper hook body 512, which is a body of the upper locking device, and the upper hook end 514 provided by perpendicularly bending from a lower end of the upper hook body 512 to a rear side thereof (a right side of FIG. 10).

Accordingly, when the upper hook end 514 of the upper locking device 510 is combined with the lower hook end 536 of the lower hook 530 (See FIG. 10), the raising/lowering device 200 can become folded.

In some implementations, an upper surface of the upper hook end 514 can be formed horizontally and a rear surface thereof can be provided to be an inclined surface. That is, as illustrated in FIG. 10, the rear surface of the upper hook end 514 can be configured to gradually incline upward toward a rear thereof.

Accordingly, when the front surface of the lower hook end 536 and the rear surface of the upper hook end 514 are configured as inclined surfaces to be in parallel with each other and the lower surface of the lower hook end 536 and the upper surface of the upper hook end 514 are configured to be horizontal, engagement of the lower hook end 536 with the upper hook end 514 can become easy and loosening of the engagement can become difficult.

That is, as illustrated in FIG. 10, while the lower hook end 536 and the upper hook end 514 are engaged with each other, each of the horizontal surfaces thereof can be in contact with each other. Accordingly, the engagement of the lower hook end 536 with the upper hook end 514 can be maintained even when the pulling force is vertically applied thereto.

Figure 11:
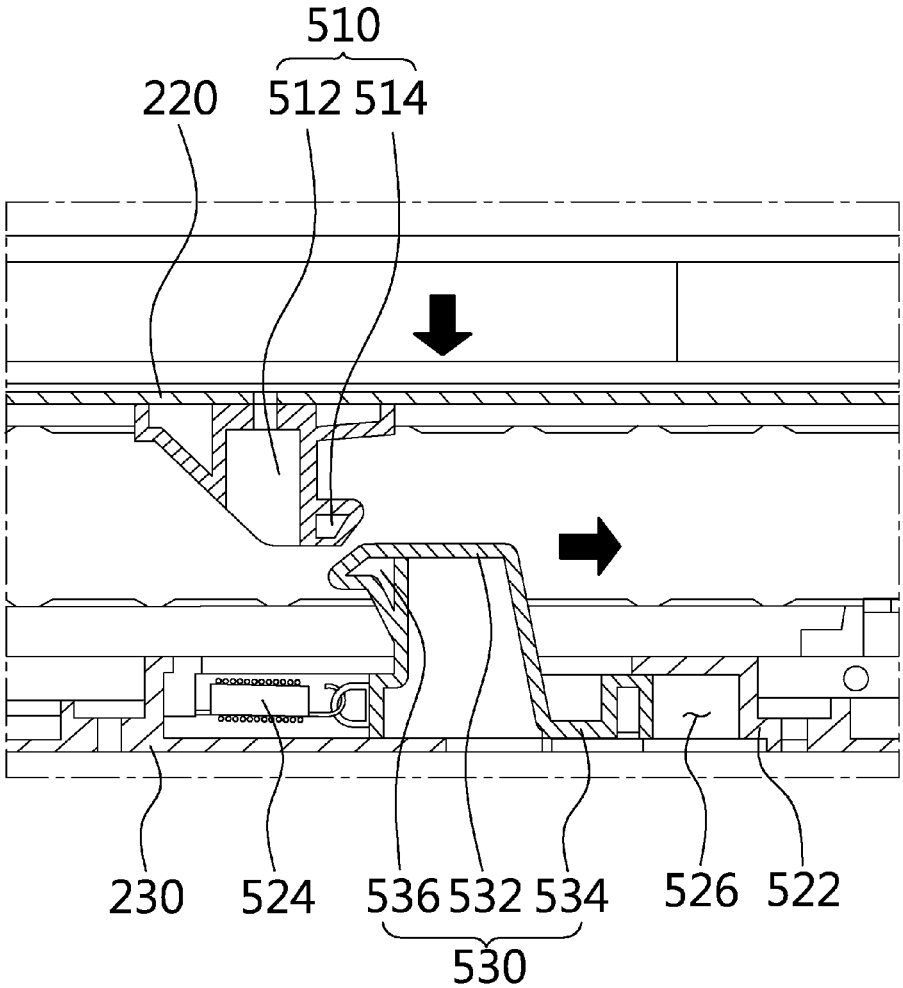
FIG. 11 is a side view illustrating an example of an upper locking device configured to automatically engage with a lower locking device, and an example of an upper frame of the raising/lowering device moving downward to an example of a lower frame.

On the other hand, as illustrated in FIG. 11, when the upper frame 220 of the raising/lowering device 200 lowers, the upper locking device 510 and the lower locking device 520 can be automatically engaged with each other. That is, since the force applying member 524 pulls the lower hook 530 forward (to a left side of FIG. 11) by the elasticity of the spring, the upper hook end 514 and the front surface (the inclined surface) of the lower hook end 536 can contact with each other when the upper hook end 514 gradually lowers and contacts with the lower hook end 536. Accordingly, the lower hook end 536 can be pushed backward (a right side of FIG. 11) and can be automatically engaged with the upper hook end 514 as illustrated in FIG. 10.

The force applying member 524 can be provided in the locking device casing 522 and function to pull the lower hook 530 forward (to the left side of FIG. 10). In some implementations, the force applying member 524 can be configured as the tension spring and functions to pull the lower hook 530 forward by the tensile elasticity.

In some examples, the raising/lowering device 200 can freely fold and unfold, but when the raising/lowering device 200 is removed upward from the storage room, the raising/lowering device 200 can maintain the folded state thereof. For example, the raising/lowering device 200 can unfold when the container 40 sits on an upper side of the raising/lowering device 200 to be moved upward and downward. When the raising/lowering device 200 is removed to the outside since the raising/lowering device is not used, the raising/lowering device 200 can be removed upward with the raising/lowering device folded.

Accordingly, the anti-loosening device can be further provided to allow the raising/lowering device 200 to rotate relative to the front end thereof such that the folded state of the raising/lowering device 200 is maintained when the raising/lowering device 200 is moved upward and removed from the storage room.

For example, an anti-loosening device can include the locking device 500 configured to restrict the raising/lowering device 200 from unfolding and a handle 215, which will be described hereinbelow. That is, apart from the locking device 500, the handle 215 configured to be held by a user can be provided at each of rear end parts of opposite side edges of the raising/lowering device 200 so as to allow the raising/lowering device 200 to rotate relative to the front end thereof. The locking device 500 can include a hook, a groove, a protrusion, or the like.

Accordingly, when a user holds and lifts the handle 215 provided at the rear end part of the raising/lowering device 200, the raising/lowering device 200 can be naturally rotated relative to the front end thereof. Accordingly, the lower locking device 520 can escape from the spacing protrusion 27*c*, which will be described hereinbelow, and the folded state of the raising/lowering device 200 can be maintained by the locking device 500.

The scissor assemblies 240 can be provided at opposite sides of the upper frame 220 and the lower frame 230 relative to a middle of each of the upper frame and the lower frame.

In some examples, each of the scissor assembly 240 can be axially coupled to the upper frame 220 and the lower frame 230. Accordingly, the upper frame 220 can move upward and downward according to the movement of the scissor assembly 240.

Each of the pair of scissor assemblies 240 provided at the opposite sides can be different only in an installation position and can be the same in a structure and shape thereof. That is, as illustrated in the accompanying drawings, the distance between the upper frame 220 and the lower frame 230 can be decreased or increased by the movement of the scissor assembly 240 having an "X" shape as a whole at each of the opposite sides.

The scissor assembly 240 can include a plate-shaped plate unit 242 and a rod unit 244 axially coupled to intersect with the plate unit 242.

In some examples, the plate unit 242 can be rotatably mounted to the lower frame 230. That is, the plate unit 242 can be rotatably installed at each of opposite ends of the lower frame 230.

The rod unit 244 can be rotatably connected to the upper frame 220. That is, for example, the rod unit 244 can be rotatably installed at each of opposite ends of the upper frame 220.

The plate unit 242 can have a rectangular plate shape and be made of aluminum alloy materials. Accordingly, the plate unit 242 can have high rigidity and be light, and can be made by die casting, for example.

The plate unit 242 can include the scissor side connection part 250 provided at a lower end thereof by protruding therefrom. That is, the scissor side connection part 250 can be provided at a front end of the plate unit 242 by further protruding forward to be integrated with the plate unit.

The rod unit 244 can be installed to intersect the plate unit 242. That is, the rod unit 244 and the plate unit 242 can unfold to have an "X" shape (as viewed from a front thereof) by intersecting each other, and an intersecting shaft 246 can be provided at a center portion at which the rod unit 244 and the plate unit 242 intersect each other such that the rod unit 244 and the plate unit 242 rotatably intersect each other.

Ends of the rod unit 244 and the plate unit 242 can be in contact with the lower surface of the upper frame 220 and the upper surface of the lower frame 230 and accordingly, the rod unit 244 and the plate unit 242 can be configured to slidably move.

In some implementations, a lower end (in FIG. 6) of the plate unit 242 can be rotatably mounted to the lower frame 230 and an upper end of the plate unit 242 can be installed on the lower surface of the upper frame 220 to slidably move. Accordingly, an upper moving guide 252 can be provided on the lower surface of the upper frame 220 to have a predetermined length to opposite sides thereof and can be in contact with the upper end of the plate unit 242 to guide the plate unit such that the plate unit slidably moves. In some examples, a roller rotating along the upper moving guide 252 can be further provided at the upper end of the plate unit 242.

An upper end (in FIG. 6) of the rod unit 244 can be rotatably mounted to each of the opposite ends of the upper frame 220, and a lower end of the rod unit 244 can be slidably installed on the upper surface of the lower frame 230.

Accordingly, a lower moving guide 254 can be installed on the upper surface of the lower frame 230 to have a predetermined length to opposite sides thereof and can be in contact with the lower end of the rod unit 244 so as to guide a sliding movement of the rod unit. A roller rotating along the lower moving guide 254 can be further provided at the lower end of the rod unit 244.

In some examples, a rear end hook 260 of a hook shape can be further provided at a rear end (a right end of FIGS. 8 and 10) of the lower frame 230 by extending backward, and a cover piece 270 can be provided at a rear end of the support plate 210 by extending backward therefrom to prevent a user's finger being trapped.

The rear end hook 260 can be held by a lower end of the inner cover 300 and the cover piece 270 can cover a gap between the raising/lowering device 200 and the inner cover 300.

In addition, the handle 215, which will be described hereinbelow, can be provided at each of rear end parts of the opposite side edges of the support plate 210.

Figure 12:
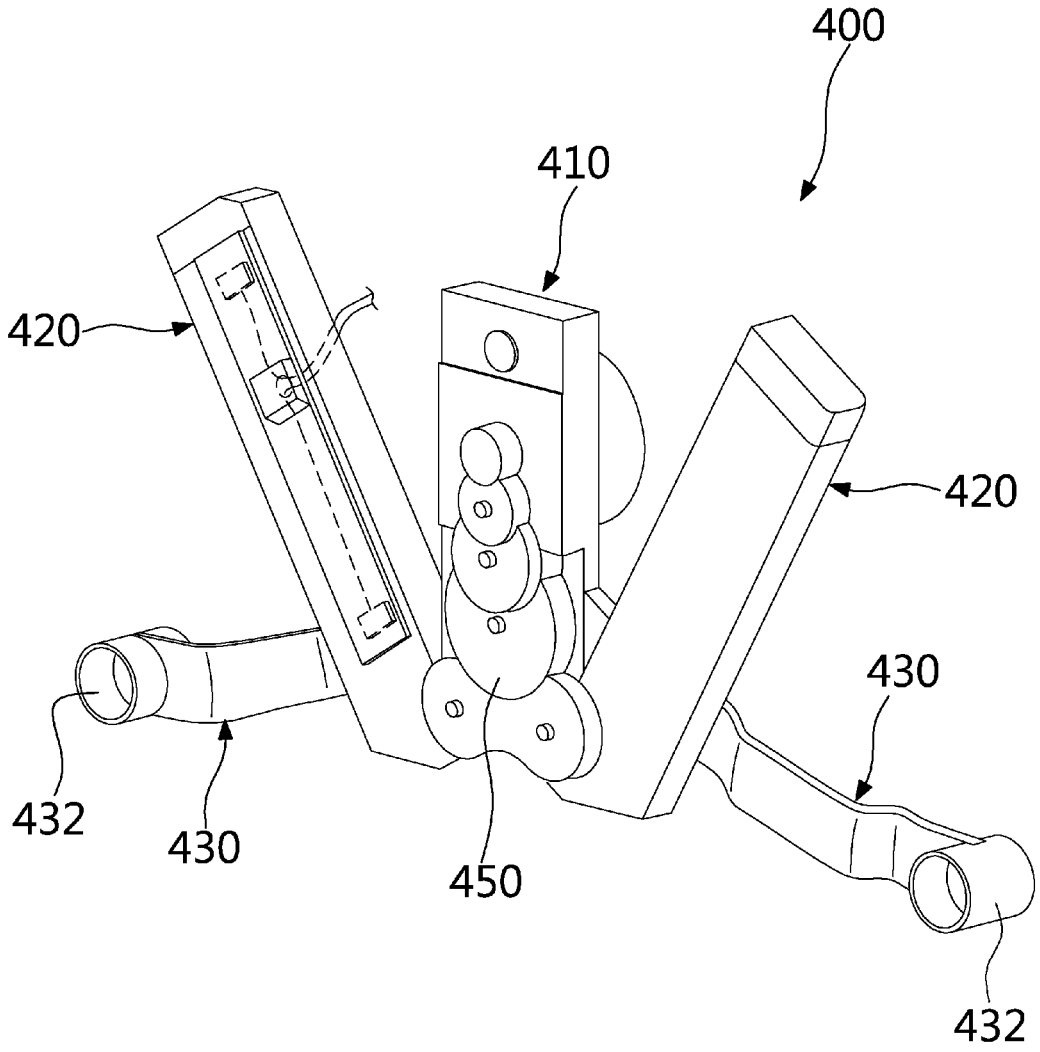
FIG. 12 is a perspective view illustrating an example of a driving device.
Figure 13:
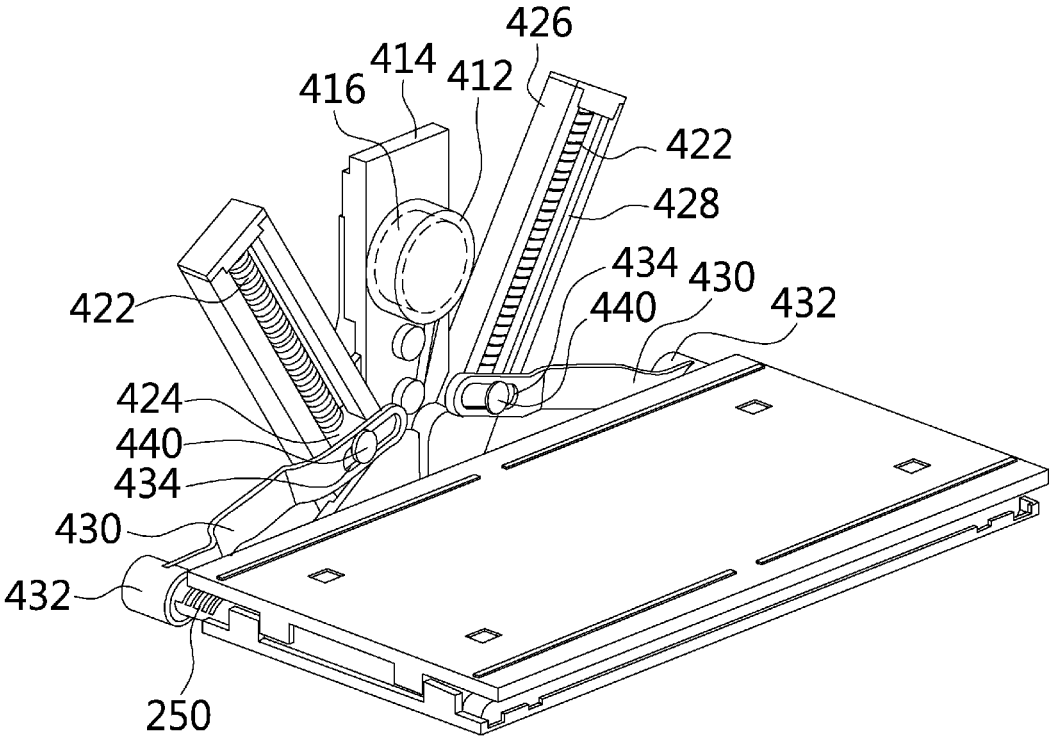
FIG. 13 is a rear perspective view illustrating the driving device and the raising/lowering device.
Figure 14:
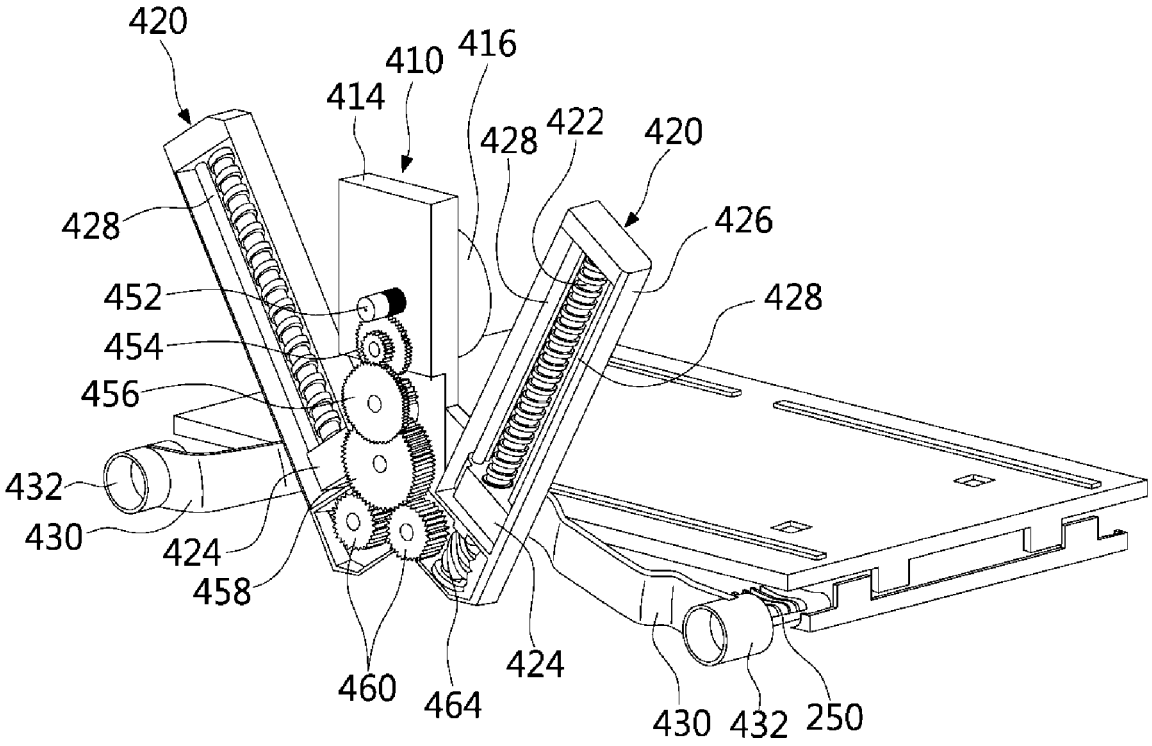
FIG. 14 is a front perspective view illustrating the driving device and the raising/lowering device.

FIG. 12 is a perspective view illustrating configuration of a driving device 400, and FIGS. 13 and 14 are a rear perspective view and a front perspective view, respectively, illustrating a state at which the driving device 400 and the raising/lowering device 200 are connected to each other.

As illustrated in these drawings, the driving device 400 can be arranged in the front panel 28 and can be connected to the raising/lowering device 200 provided at a rear side thereof. Accordingly, power generated by the driving device 400 can be transmitted to the raising/lowering device 200.

The driving device 400 can transmit power simultaneously to the opposite sides of the raising/lowering device 200. Accordingly, in some examples, the raising/lowering device 200 can move upward and downward in parallel in the opposite sides thereof without slanting.

The driving device 400 can include a motor assembly 410, a screw unit 420 arranged at each of opposite sides of the motor assembly 410 to have a pair of screw units, and a lever 430 connected to each of the screw units 420 to have a pair of levers.

In addition, the screw unit 420 can include a screw 422 and the screw holder 424, through which the screw 422 passes, moving upward and downward along the screw 422.

A lever connection part 432 can be provided at an end of the lever 430 and the lever connection part 432 can be rotatably fixed to a rear surface of the front panel 28. The lever connection part 432 can be combined with the scissor side connection part 250.

A lever hole 434, into which a holder engaging member 440 is locked, can be provided in an inner end of each of the pair of the levers 430.

The lever hole 434, which is configured to be a longitudinal hole, can guide movement of the holder engaging member 440 and at the same time allow the holder engaging member 440 to be engaged with the screw holder 424. Accordingly, the lever 430 can be rotated by the screw holder 424 moving upward and downward during rotation of the screw 422.

The motor assembly 410 can be positioned at a middle portion of the front panel 28.

A drive motor 412 can be provided in the motor assembly 410 and the screw units 420 and the levers 430 of the opposite sides of the motor assembly 410 can be operated by the motor assembly 410 including the drive motor 412.

The motor assembly 410 can allow speed reduction and a magnitude of a transmitted force to be adjusted by combination of multiple gears. In addition, the motor assembly 410 can have a structure of having the drive motor 412 and the gears vertically arranged so as to minimize a recessed space of the front panel when the motor assembly 410 is installed in the front panel 28. In some cases, to minimize a thickness of the motor assembly 410, a width of opposite side directions thereof can be increased, and a thickness of forward and backward directions thereof can be decreased.

In some examples, the drive motor 412 of the motor assembly 410 protrudes to the storage room 27 so as to allow a recessed depth of the front panel 28 to be minimized such that a thermal insulation performance of the front panel is guaranteed.

The drive motor 412 can provide power to the raising/lowering device 200 such that the raising/lowering device 200 is moved upward and downward and can be configured to rotate clockwise/counterclockwise. Accordingly, when an upward or downward moving signal of the raising/lowering device 200 is input, the drive motor 412 can rotate clockwise or counterclockwise and provide power to the raising/lowering device 200 so that the raising/lowering device is moved upward and downward. Furthermore, the drive motor 412 can be stopped at the input of a stop signal by a load thereof or detection of a sensor.

The motor assembly 410 can include the drive motor 412, a motor casing 414 in which the drive motor 412 is installed, and a motor cover 416 with which the motor casing 414 is combined and covers the drive motor 412.

A rotating shaft of the drive motor 412 can protrude from the motor casing 414 toward a side opposite to a side of the motor cover 416. Furthermore, the motor assembly 410 can further include a power transmission part to transmit the power of the drive motor 412.

The power transmission part can be positioned at a side opposite to a side of the drive motor 412 relative to the motor casing 414.

The power transmission part can be configured by the combination of the multiple gears and can be covered by a cover member 450 mounted at a side (a front of the motor casing) opposite to the side of the drive motor 412.

The power transmission part can include a drive gear 452 connected to the shaft of the drive motor 412 passing through the motor casing 414, a first transmission gear 454 provided at a lower side of the drive gear 452 to mesh therewith, a second transmission gear 456 meshing with the first transmission gear 454, a third transmission gear 458 meshing with the second transmission gear 456, and a pair of cross gears 460 meshing with the third transmission gear 458.

In addition, as illustrated in FIG. 14, the second transmission gear 456 meshing with the first transmission gear 454 can be configured as a multi-stage gear to mesh with the upper and lower gears each other.

The cross gears 460 can be configured to include spur gears and helical gears.

That is, a first helical gear part can be provided at a rear of each of the cross gears 460 configured to have a spur gear shape, and the first helical gear part can mesh with a second helical gear part 464 of a side of each of the cross gears.

A rotation center line of the second helical gear part 464 can be arranged to intersect a rotation center line of the cross gear 460. Accordingly, the first helical gear part and the second helical gear part 464 can be combined with each other in a state intersecting with each other and are configured to be engaged with each other so as to allow rotations thereof to be transmitted to each other.

The rotation center line of the cross gear 460 can extend in a front to rear direction thereof and the rotation center line of the second helical gear part 464 can extend in an inclined vertical direction. Furthermore, as illustrated in FIG. 14, each of the rotation center lines of the second helical gear parts 464 arranged at the opposite sides of the cross gears can be arranged to be inclined in a direction gradually moving away from each other upward.

The screw unit 420 can be arranged at each of the opposite sides of the motor assembly 410.

The screw unit 420 can be arranged at each of the opposite sides of an inner side of the front panel 28 and each of the pair of the screw units 420 can be different only in an installation position thereof, but can be the same in a structure and shape thereof.

The power of the drive motor 412 can be transmitted to a lower part of the screw unit 420. Each of the screw units 420 of the opposite sides can be symmetrical to each other relative to the motor assembly 410.

Accordingly, the motor assembly 410 can be arranged between the screw units 420 positioned at the opposite sides, and each of the screw units 420 arranged at the opposite sides can be arranged to have a shorter distance therebetween toward a lower end thereof from an upper end thereof.

The screw unit 420 can include the screw 422 rotated by receiving the power of the drive motor 412, wherein the screw 422 can extend in upward and downward directions and can be inclined such that an upper end thereof faces the outside thereof and a lower end thereof faces an inside thereof.

The screw 422 can be connected to the second helical gear part 464. Accordingly, the screw 422 can rotate together with the second helical gear part 464 during rotation thereof.

The screw unit 420 can be further provided with the screw holder 424 through which the screw 422 passes to be combined therewith, wherein the screw holder 424 can move upward and downward along the screw 422 during rotation of the screw 422.

In addition, since the lever 430 is combined with the screw holder 424, the lever 430 can rotate during movement of the screw holder 424.

Accordingly, during the rotation of the screw 422, the screw holder 424 can move along the screw 422.

In addition, a magnet can be provided in the screw holder 424.

The magnet can be provided such that a position of the screw holder 424 is detected and when the screw holder 424 is positioned at a lowest end or a top end of the screw 422, the raising/lowering detection device can detect this. That is, completion of an upward or downward movement of the raising/lowering device can be determined by whether the magnet installed in the screw holder 424 is detected.

The lever 430 can connect the screw holder 424 with the raising/lowering device 200 and each of opposite sides of the lever can be combined with each of the screw holder 424 and the raising/lowering device 200.

The screw unit 420 can further include a housing 426 receiving the screw unit 420.

The housing 426 can constitute an outer surface of the screw unit 420 and include a space in which the screw unit 420 and the screw holder 424 are received.

The housing 426 can be formed by bending a plate shaped metal material or can be formed of a plastic material.

The housing 426 can be provided with at least one guide bar 428 to guide lifting of the screw holder 424. The at least one guide bar 428 can extend in parallel with the screw 422 while being spaced apart from the screw 422.

A plurality of guide bars 428 can be provided in the housing 426 such that the screw holder 424 is not displaced to any side of a left or right side relative to the screw 422, and the screw 422 can be positioned between the plurality of guide bars 428.

The motor casing 414 and a pair of housings 426 can be integrated with each other. Furthermore, a single cover member 450 can cover the motor casing 414 and the pair of housings 426. That is, the cover member 450 can be combined with the motor casing 414 to cover the power transmission part, and can be combined with the pair of housings 426 to cover the screw 422, the guide bars 428, and the screw holder 424.

Since the driving device 400 exists as a module, the driving device 400 can become compact and thus the driving device 400 can be easily installed in the front panel 28.

Figure 15:
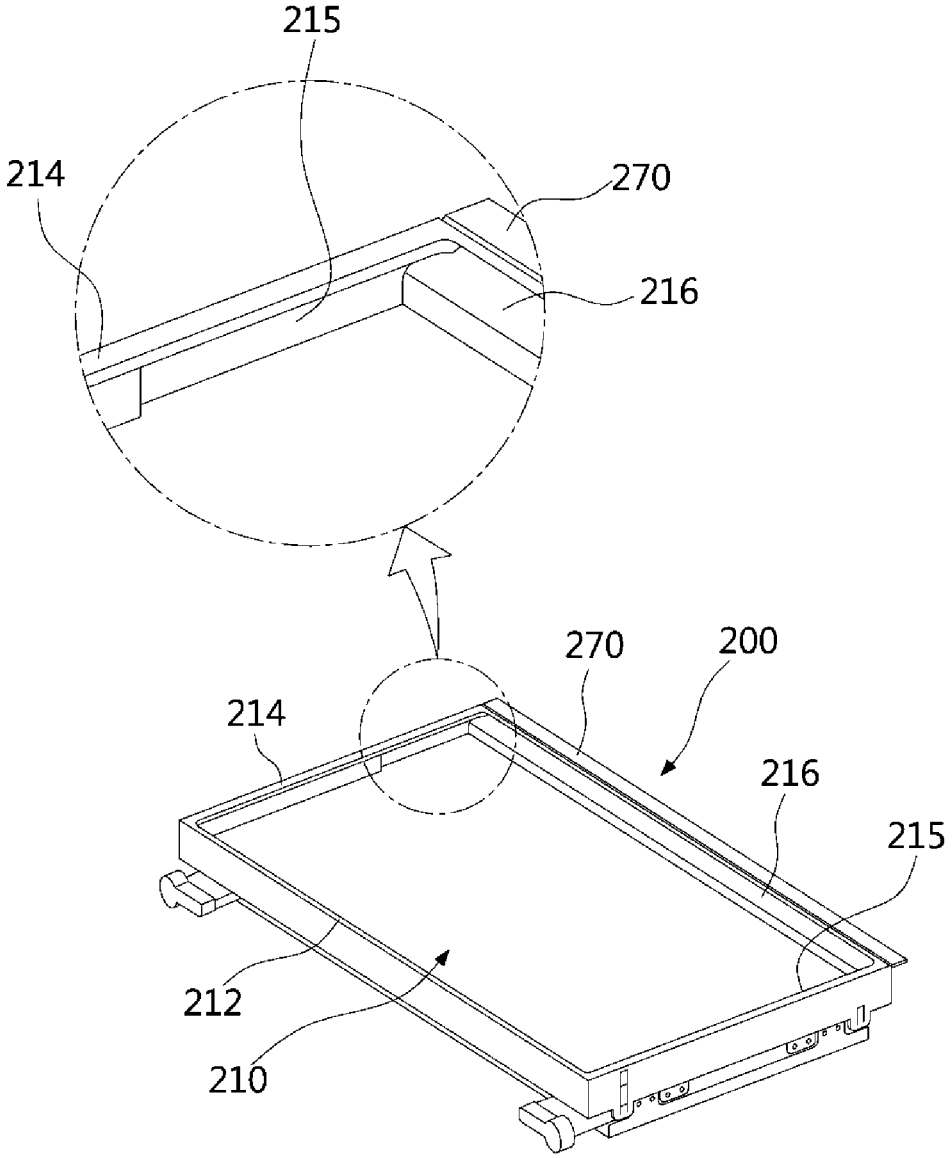
FIG. 15 is a perspective view illustrating the raising/lowering device in a folded state.

FIG. 15 is a perspective view of a state of the raising/lowering device folded.

As illustrated in FIG. 15, the support plate 210 can constitute an upper outer surface of the raising/lowering device 200.

In addition, the support plate 210 can be a rectangular flat plate as a whole, and each of edges thereof can protrude upward to have a predetermined height. Accordingly, the upper surface of the support plate 210 can be entirely formed such that an inner part of each of the edges thereof is depressed, so that a lower end of the container 40 can be easily seated.

The edges of the support plate 210 can include a front edge 212 provided by protruding upward from an upper surface of a front end thereof, side edges 214 provided by protruding upward from opposite sides thereof, and a rear edge 216 provided by protruding upward from an upper surface of a rear end thereof.

An upper end of the rear edge 216 can extend backward to have the cover piece 270, and as described above, the cover piece 270 can cover the gap between the raising/lowering device 200 and the inner cover 300 such that fingers of a user or a child are prevented from being trapped in the gap.

Each of the side edges 214 can be further provided with the handle 215 at the rear end part thereof.

The handle 215 can be a part held by fingers of a user when the user takes out the raising/lowering device 200 from the inner part of the storage room 27.

As illustrated in the drawings, the handle 215 can be configured to be recessed from an inner surface of each of the pair of the opposite side edges 214 to an outer side thereof. Accordingly, a user can move his/her fingers from a middle of the upper surface of the support plate 210 to each of the pair of side edges 214, put his/her fingers in the recessed portion of the handle 215, and lift the raising/lowering device upward.

Accordingly, the raising/lowering device 200 can rotate relative to the front end thereof and the rear end part thereof is lifted upward.

Figure 16:
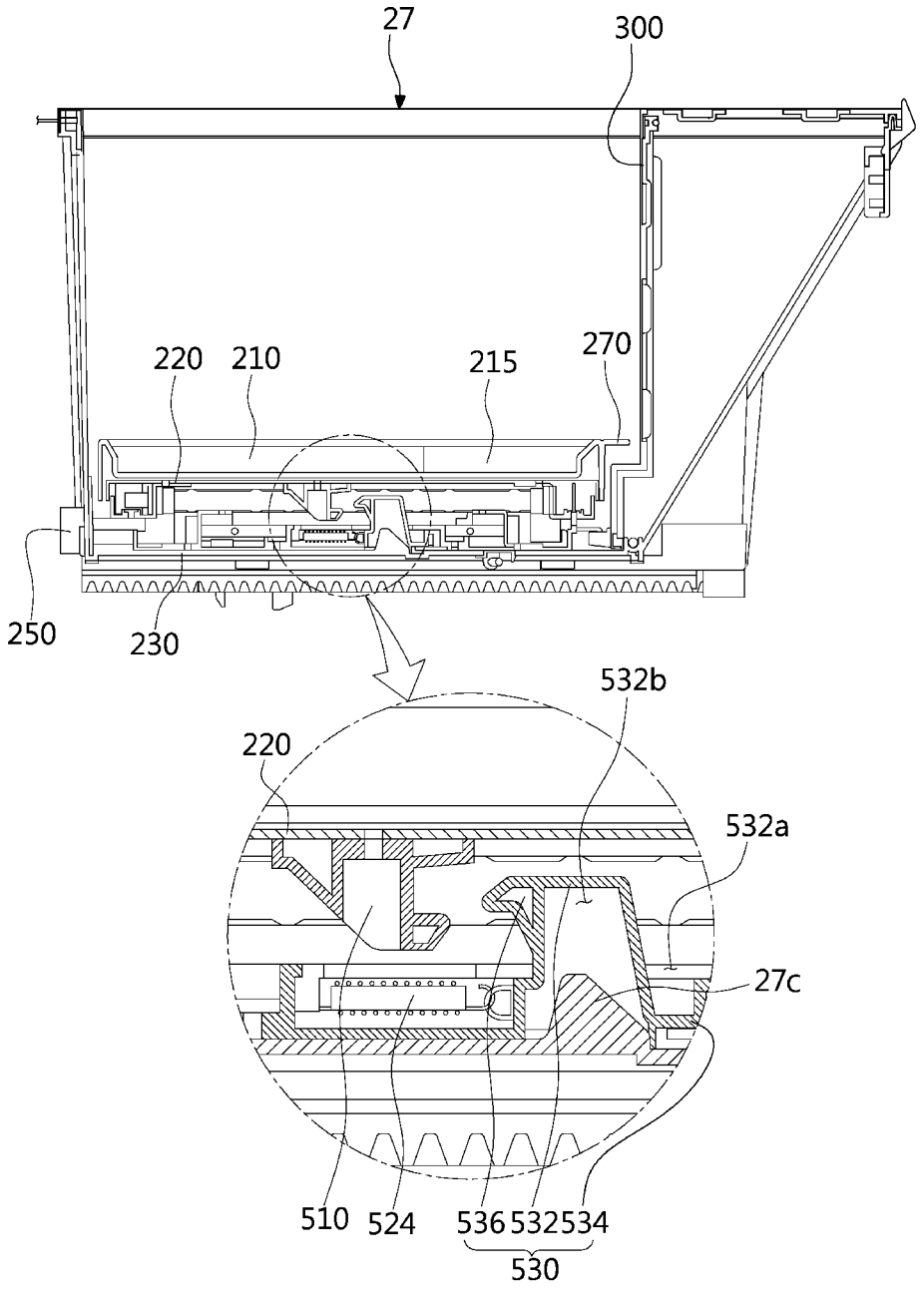
FIG. 16 is a sectional view illustrating the raising/lowering device mounted in the storage room.
Figure 17:
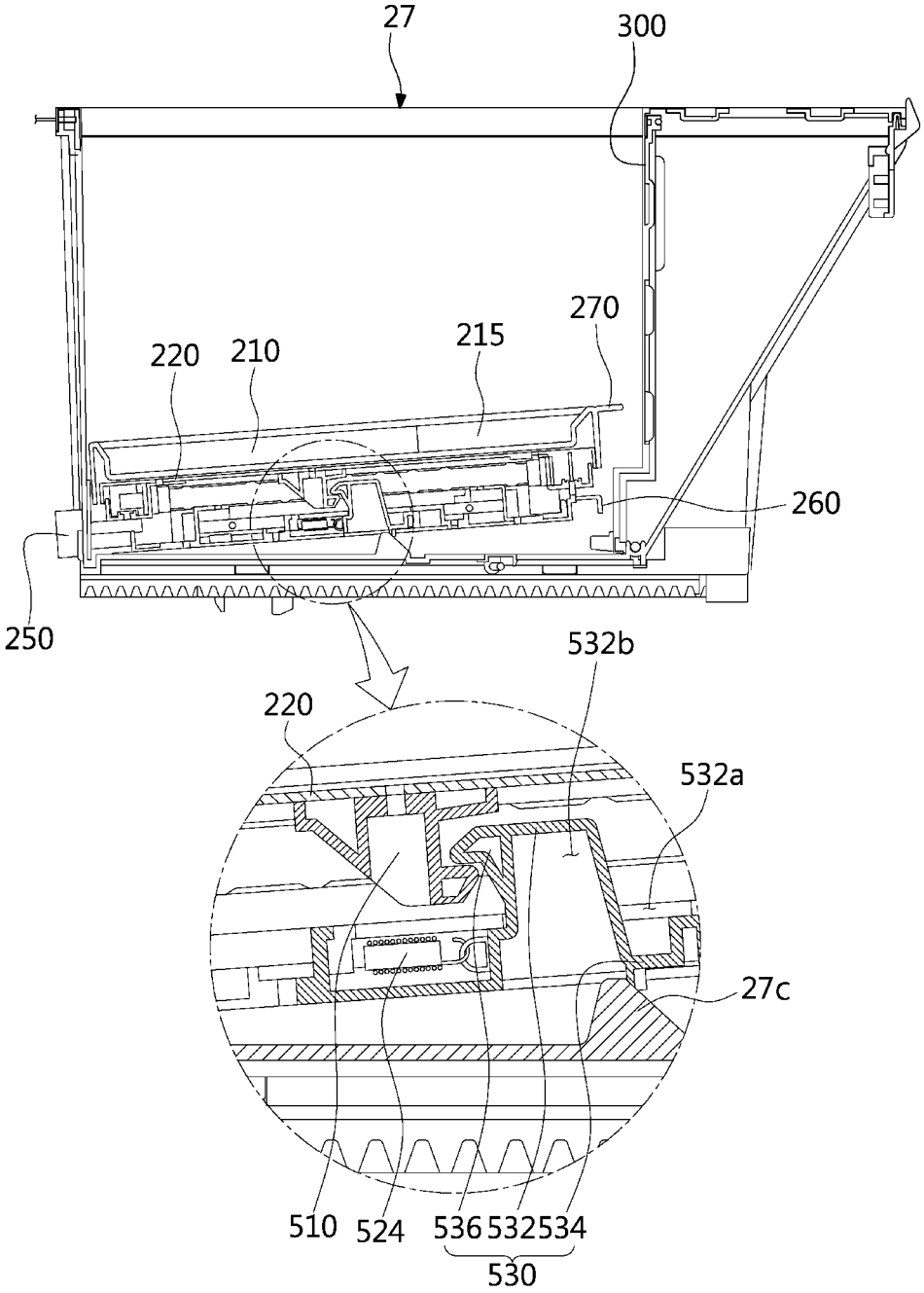
FIG. 17 is a partial sectional view illustrating the raising/lowering device lifted upward in the storage room.

FIG. 16 is a sectional view of a state of the raising/lowering device 200 mounted in the storage room 27, and FIG. 17 is a partial sectional view illustrating a state at which the raising/lowering device 200 mounted in the storage room 27 is lifted upward.

First, as illustrated in FIG. 16, the raising/lowering device 200 can sit on the bottom surface of the inner part of the storage room 27. In this case, the scissor side connection part 250 of the raising/lowering device 200 can pass through the connection hole 27*b* of the storage room 27 and accordingly, a front end of the scissor side connection part 250 can protrude to the front (a left side of FIG. 16) of the storage room 27.

In addition, the lower hook 530 can move backward (a right side of FIG. 16) to be separated from the upper locking device 510. Accordingly, the upper frame 220 and the lower frame 230 may not be locked to each other in the folded state.

In some implementations, the storage room 27 can include the spacing protrusion 27*c* provided at a middle part thereof by protruding upward therefrom, and the lower hook 530 can be moved backward (the right side of FIG. 16) by the spacing protrusion 27*c*.

As illustrated in FIG. 16, the spacing protrusion 27*c* can have a triangular or wedge shape (e.g., "A" shape) having a pointed upper side. In some examples, a front surface (a left-side surface of FIG. 16) of the spacing protrusion 27*c* can be vertically configured, and a rear surface thereof (a right-side surface of FIG. 16) can be inclined.

This is because a rear end part of the protrusion groove 532*b* of the lower hook 530 is in a sliding contact with the rear surface of the spacing protrusion 27*c* therealong.

In some implementations, the upper locking device 510 and the lower hook 530 of the raising/lowering device 200 can be engaged with each other to maintain the folded state thereof outside of the storage room 27. Accordingly, when the raising/lowering device 200 of the folded state is installed on the bottom surface from an upper part of the storage room 27, the raising/lowering device 200 can be brought into a close contact with the bottom surface of the storage room 27 by weight.

Accordingly, in this case, the rear surface of the spacing protrusion 27*c* can be in contact with a rear end of a lower surface of the lower hook body 532 of the lower hook 530. As the raising/lowering device 200 gradually lowers downward, the elasticity of the force applying member 524 configured as the tension spring does not overcome a downward moving force of the raising/lowering device 200, and accordingly, the rear end of the lower surface of the lower hook body 532 of the lower hook 530 can gradually slide along the rear surface of the spacing protrusion 27*c* as illustrated in FIG. 16.

In this case, the spacing protrusion 27*c* can be received in the protrusion groove 532*b* provided in the lower hook body 532, and the lower hook 530 and the upper locking device 510 can be spaced apart from each other and accordingly may not be engaged with each other.

Accordingly, the spacing protrusion 27*c* can be received in the protrusion groove 532*b*, and the lower locking device 520 and the upper locking device 510 can be separated from each other such that the locking device 500 can be unlocked. Accordingly, the raising/lowering device 200 can be unfolded in this state.

In some examples, to maintain the folded state of the raising/lowering device 200, the spacing protrusion 27*c* can escape from the protrusion groove 532*b*.

As described above, to take out the raising/lowering device 200 upward while the raising/lowering device 200 sits on the bottom surface of the storage room 27, the handle 215 can be lifted upward while the handle is held by each of the hands.

In this case, while the raising/lowering device 200 rotates counterclockwise relative to the front end part thereof, the rear end part thereof (a right end of FIG. 16) can be lifted upward.

When the rear end part of the raising/lowering device 200 is moved upward, the rear end of the lower surface of the lower hook body 532 of the lower hook 530 can gradually be moved upward by sliding along the rear surface of the spacing protrusion 27*c*.

When the rear end of the raising/lowering device 200 moves up, the raising/lowering device 200 can slant gradually. Since the force applying member 524 is the tension spring, the force applying member continuously can pull the lower hook 530 forward. Accordingly, the lower hook 530 can move forward while moving upward gradually and thus is engaged with the upper locking device 510.

That is, as illustrated in FIG. 17, before the lower end of the lower hook 530 moves away from the upper end of the spacing protrusion 27*c*, the lower hook 530 and the upper locking device 510 can be engaged with each other.

In this case, when the raising/lowering device 200 is inclined at about 3 degrees relative to the bottom surface of the storage room 27, the lower hook 530 and the upper locking device 510 can be engaged with each other.

Accordingly, since the lower hook 530 of the lower locking device 520 and the upper locking device 510 are engaged with each other when the rear end part of the raising/lowering device 200 is lifted upward, the raising/lowering device 200 can be maintained at the folded state and the scissor side connection part 250 can deviate from the connection hole 27*b* of the storage room 27. Accordingly, the raising/lowering device 200 can be completely removed from the upper side of the storage room 27.

In some examples, in the above description, the handle 215 is defined in the rear end part of each of the side edges 214 of the support plate 210. However, the handle 215 can be famed in the rear edge 216 of the support plate 210 as long as the rear end part of the raising/lowering device 200 is raised while the raising/lowering device 200 rotates relative to the front end part thereof.

Figure 18:
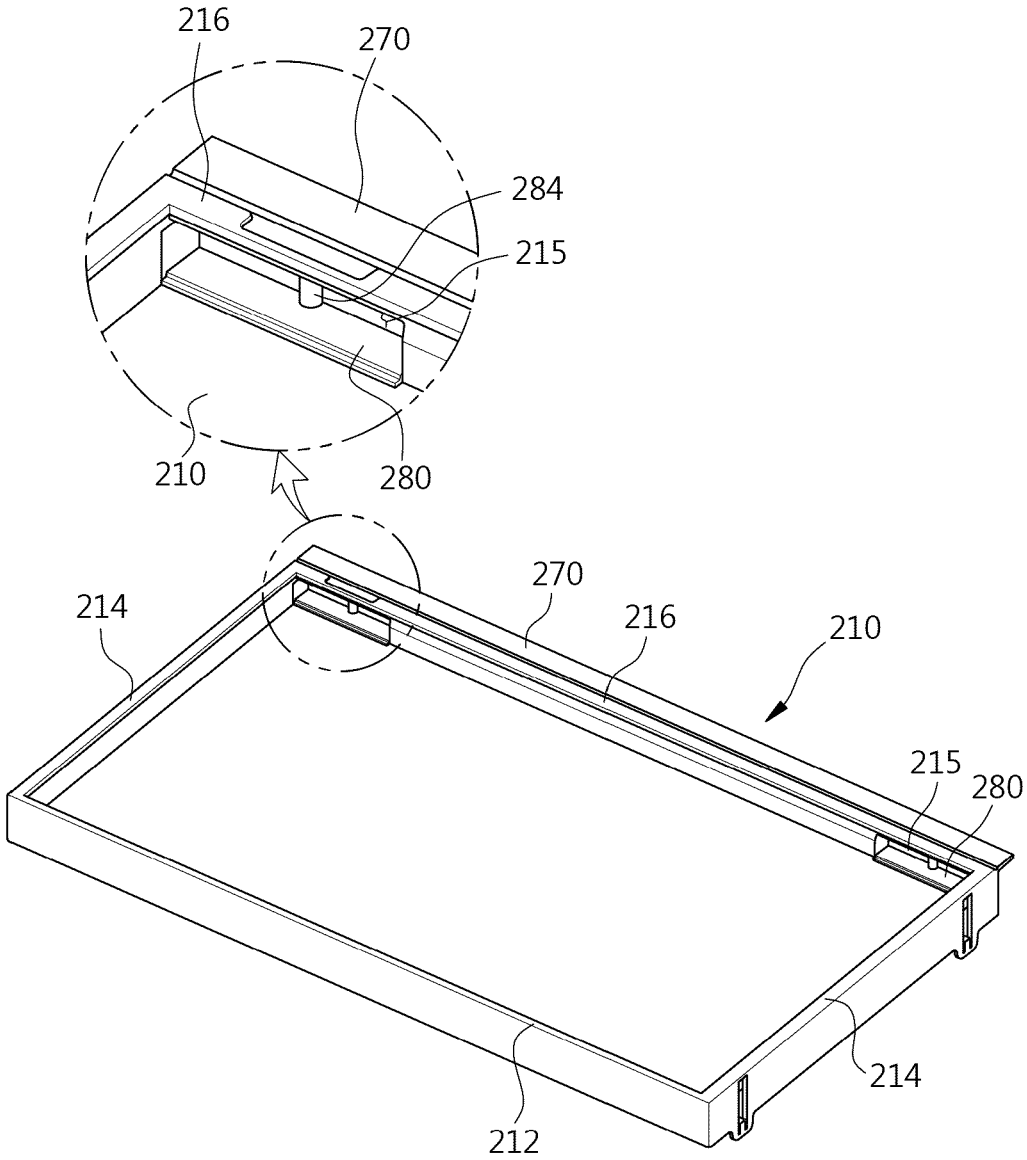
FIG. 18 is a perspective view illustrating an example of a support plate.
Figure 19:
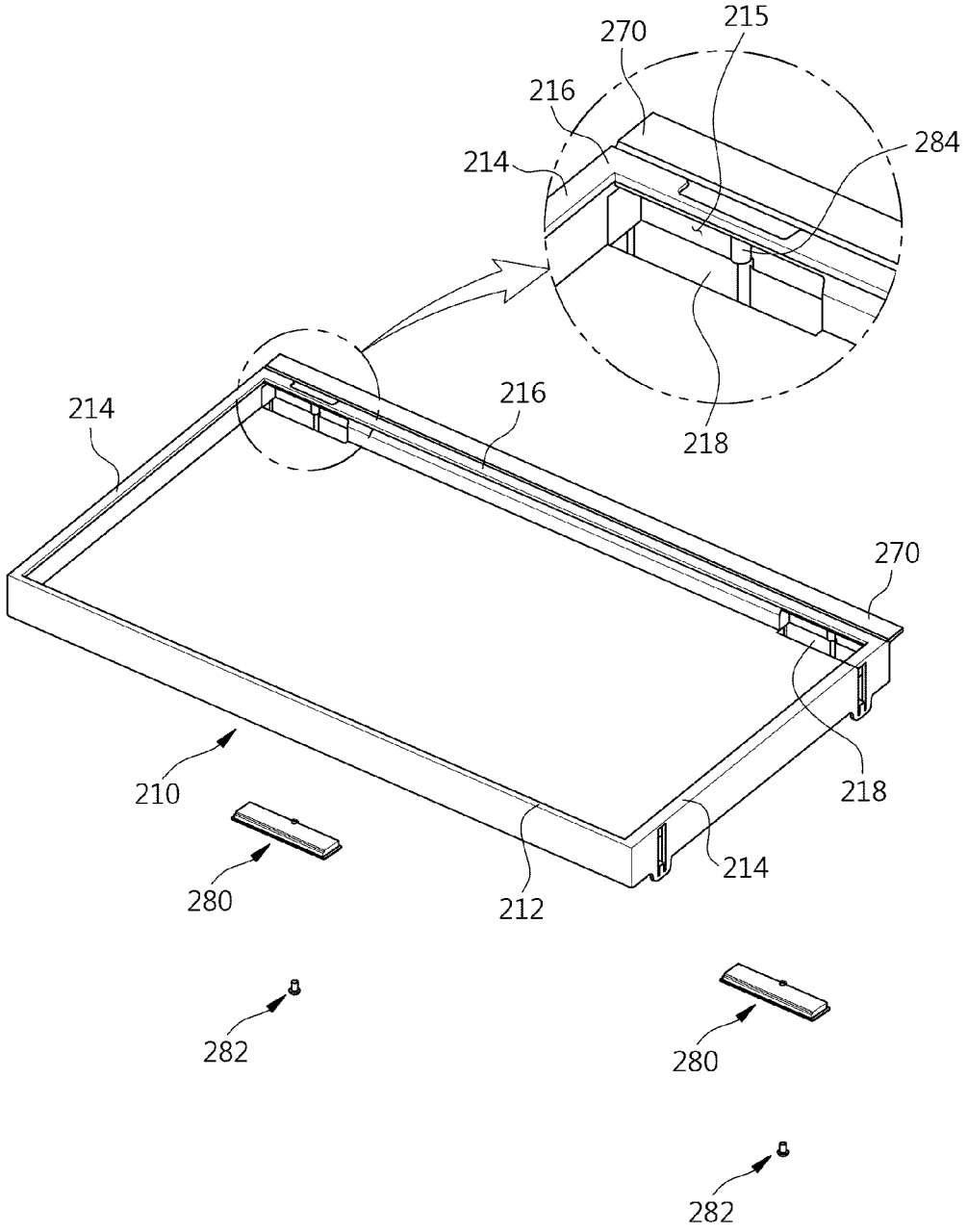
FIG. 19 is an exploded perspective view illustrating the support plate in FIG. 18.
Figure 20:
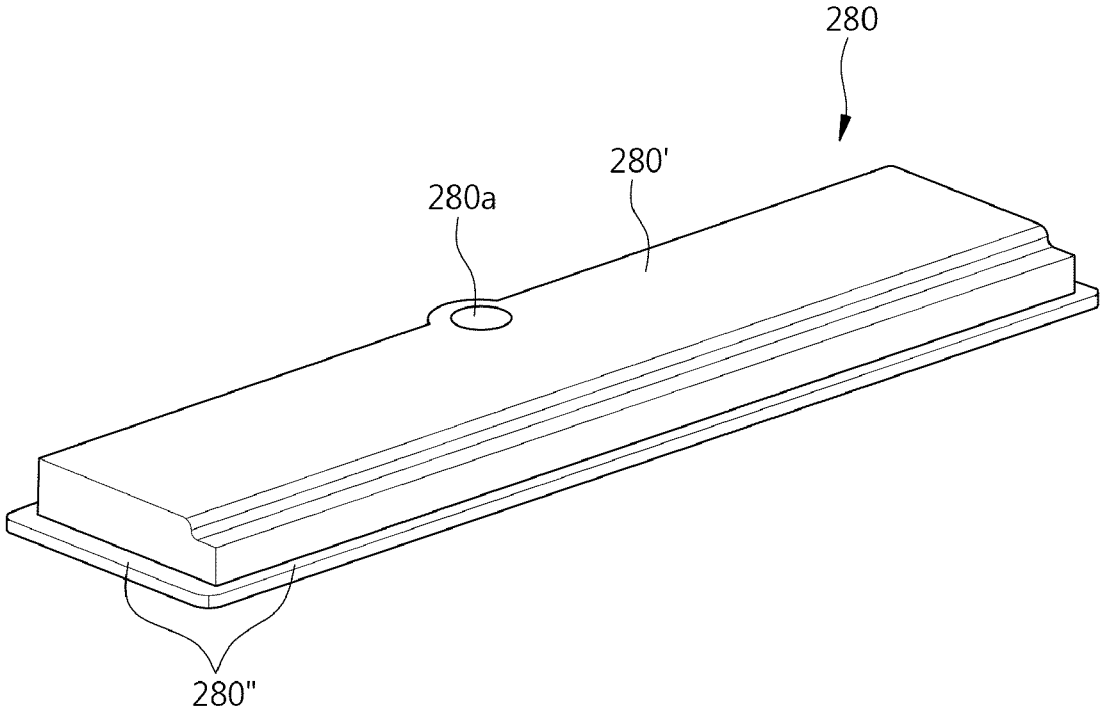
FIG. 20 is a perspective view illustrating an example of a cover plate provided in the support plate in FIG. 18.

In FIGS. 18 to 23, the handle 215 is define in the rear edge 216 of the support plate 210. That is, FIGS. 18 and 19 illustrate a perspective view and an exploded perspective view, respectively, of the configuration of the support plate 210, and FIG. 20 is a perspective view illustrating the configuration of a cover plate 280 provided in the support plate 210.

Figure 21:
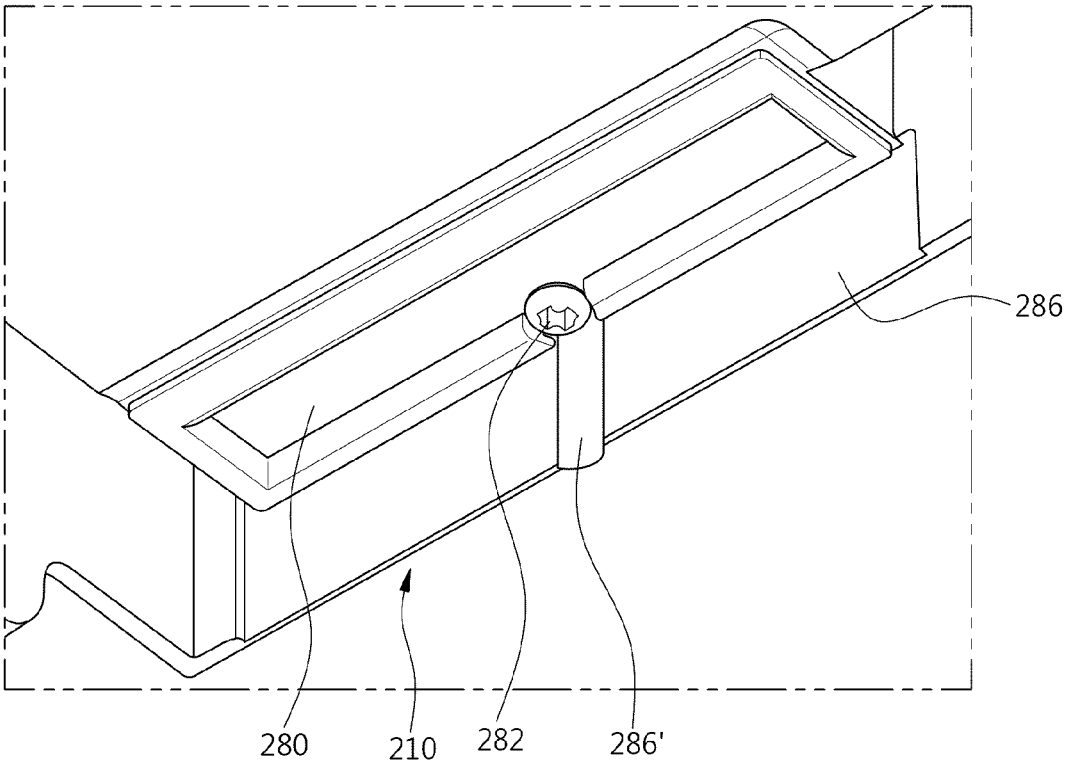
FIG. 21 is a partial bottom perspective view illustrating the cover plate illustrated in FIG. 20, which is mounted to the support plate.
Figure 22:
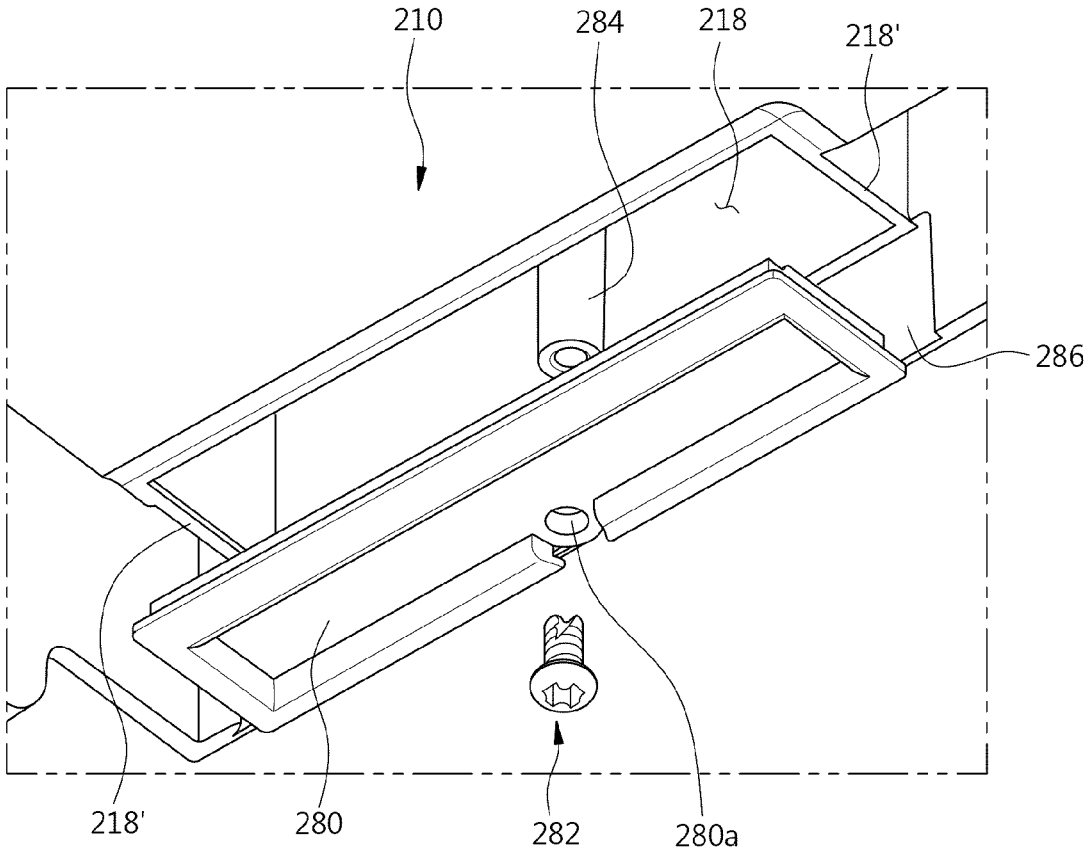
FIG. 22 is a bottom exploded perspective view illustrating the cover plate illustrated in FIG. 20, which is removed from the support plate.
Figure 23:
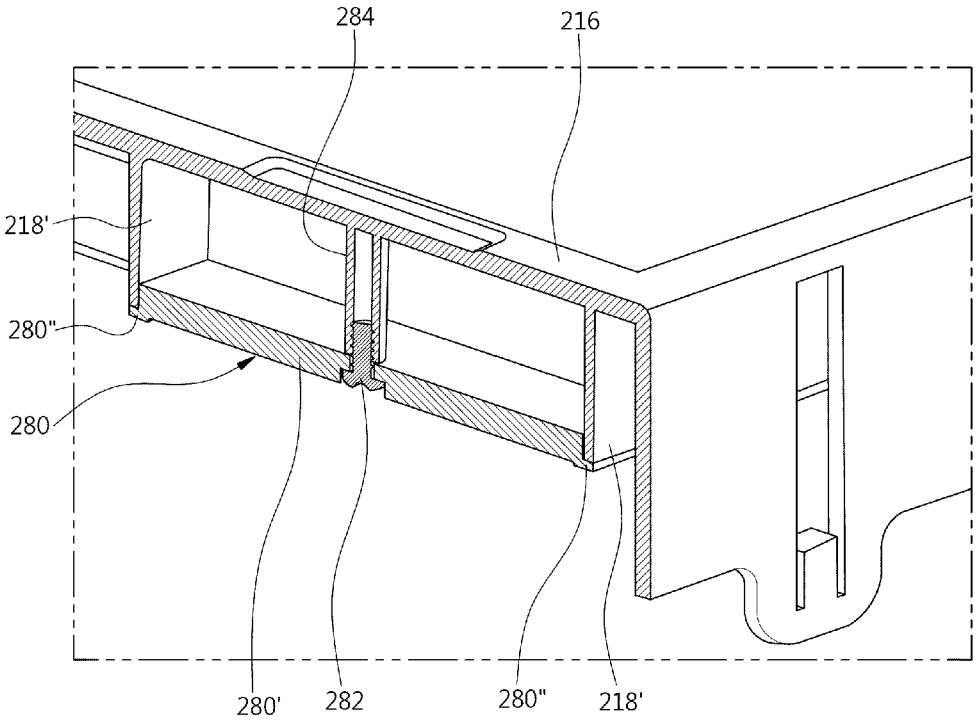
FIG. 23 is a partial cut-away perspective view illustrating the cover plate illustrated in FIG. 20, which is mounted to the support plate.

Furthermore, FIGS. 21 and 22 are a partial bottom perspective view and an exploded perspective view, respectively, illustrating the state of the cover plate 280 mounted to the support plate 210 and the state of the cover plate 280 removed therefrom, and FIG. 23 is a partial cut-away perspective view illustrating the mounted state of the cover plate 280. (Hereinafter, components having the same functions as described above use the same reference numerals, and detailed description thereof will be omitted.)

As illustrated in these drawings, the support plate 210 can have the shape of a rectangular flat plate, and can constitute the appearance of the upper surface of the raising/lowering device 200. The inner portion of the upper surface can be depressed so as to easily seat and couple the container 40 thereto.

Here, a surface corrosion can be applied to the support plate 210. That is, in some examples, the same surface corrosion as the surface corrosion of the main body of a refrigerator can be applied to the support plate 210, and the surface quality of the support plate 210 can be improved by such a surface corrosion.

In addition, the handle 215 configured to be grasped by a user can be formed in a rear end of such a support plate 210. That is, the edges of the support plate 210 can protrude upward such that each of the edges thereof has a predetermined height, and the inner portion of the edges can be depressed so that the lower end of the container 40 is easily seated thereon. The handle 215 can be formed in the rear end of such an edge.

In some implementations, the edges of the support plate 210 can include the front edge 212 protruding upward from the upper surface of the front end thereof, the side edges 214 protruding upward from opposite sides thereof, and the rear edge 216 protruding upward from an upper surface of a rear end thereof.

In addition, at least one handle 215 can be formed in the rear edge 216. As described above, the handle 215 can be a part into which a user inserts his or her finger to lift the raising/lowering device.

In the present disclosure, a case in which the handle 215 is formed in each of the opposite ends of the rear edge 216 is described as an example. That is, the handle 215 can be formed in each of the opposite ends of the rear edge 216 to have a pair of handles.

In some implementations, the handle 215 can be configured to have the shape of a groove recessed from the front surface of the rear edge 216 to the rear side thereof. Accordingly, a user can insert his or her finger into the handle 215 from the front thereof and upward raise the rear end of the support plate 210.

A handle hole 218 can be formed at the lower side of the handle 215 by being vertically formed therethrough. The handle hole 218 can be molded by being manufactured in the structure of removing molds up and down, and can have a rectangular shape.

The handle hole 218 can be covered by the removable cover plate 280.

The cover plate 280 can be coupled to the support plate 210 by a fastening bolt 282.

In some examples, the cover plate 280 can be coupled to the support plate 210 by various types of fastening devices other than the bolt.

A bolt fastening part 284 to which the fastening bolt 282 is screwed can be provided in the rear edge 216. That is, as illustrated in the drawings, the bolt fastening part 284 can be formed by protruding forward from the rear end of the handle 215 formed in the rear edge 216, and a tap can be famed on the lower end of such a bolt fastening part 284 such that the fastening bolt 282 is screwed thereto.

The bolt fastening part 284 can be vertically formed in the rear edge 216, and in some examples, the vertical length of the bolt fastening part 284 can have the size corresponding to the vertical length of the handle 215.

Particularly, as illustrated in the drawings, the handle 215 can be configured to have the shape of a rectangular box by being recessed to the rear side of the rear edge 216 and being open in the front thereof. The bolt fastening part 284 can be formed by partially protruding forward from the middle portion of the rear surface of the handle 215, wherein the vertical length of the bolt fastening part 284 can be formed to correspond to the vertical length of the handle 215.

In addition, the edge of the support plate 210 can have a lower edge 286 by further extending to the lower side thereof, and a guide groove 286' can be formed in the rear surface of such a lower edge 286 by being recessed rearward such that the fastening bolt 282 does not interfere with the lower edge 286 when the fastening bolt 282 is screwed to the bolt fastening part 284.

The cover plate 280 can include a body part 280' having an area corresponding to the area of the handle hole 218, and an edge part 280" formed by protruding from the lower surface of the body part 280' to the outside.

As illustrated in the drawings, the body part 280' can have a rectangular shape, and the edge part 280" can be formed by protruding from the lower end of the outer surface of such a body part 280' to the outside to have a predetermined size.

The edge part 280" can be configured to have size larger than the area of the handle hole 218 so as to be in close contact with and coupled to the lower surface of the handle hole 218.

Particularly, the size of the outer surface of the body part 280' can be formed to correspond to the size of the inner surface of the handle hole 218, so the body part 280' can be received in the handle hole 218 and cover the handle hole 218.

A hole wall 218' having a rectangular shape can be formed on the outer surface of the handle hole 218, and the edge part 280" can be in close contact with and be coupled to the lower end of such a hole wall 218'.

A bolt hole 280*a* through which the fastening bolt 282 passes can be formed in the cover plate 280 by being vertically formed therethrough. That is, as illustrated in the drawing, the bolt hole 280*a* having a predetermined size through which the fastening bolt 282 passes can be formed in the rear end of the middle portion of the cover plate 280 by being vertically formed therethrough.

Accordingly, as illustrated in FIG. 22, after the fastening bolt 282 passes through the bolt hole 280*a* of the cover plate 280 from the lower side thereof to the upper side thereof, the fastening bolt 282 is screwed to the bolt fastening part 284 of the rear edge 216. In this case, as illustrated in FIGS. 21 and 23, the cover plate 280 can be coupled to the rear edge 216, and cover the handle hole 218.

Although the implementations of the present disclosure have been described for illustrative purposes, those skilled in the art will appreciate that various modifications, additions and substitutions are possible, without departing from the scope and spirit of the disclosure as disclosed in the accompanying claims.

What is claimed is:

1. A refrigerator comprising:

a cabinet that defines a storage chamber therein and a front opening in communication with the storage chamber;

a cooling device configured to cool the storage chamber;

a drawer coupled to the cabinet and comprising a front panel that is configured to move forward and backward to open and close at least a portion of the front opening of the cabinet and a storage room that is disposed at a rear of the front panel;

an elevation device disposed inside of the storage room and comprising a support plate configured to move upward; and a driving device disposed inside the front panel, wherein the storage room includes:

a front surface facing the front panel and disposed between the driving device and the elevation device; and a connection hole disposed at the front surface of the storage room, wherein the driving device includes a first connection part rotatably disposed in front of the connection hole, and wherein the elevation device includes a second connection part coupled to the first connection part through the connection hole to move the support plate upward.

2. The refrigerator of claim 1, wherein the elevation device comprises:

a lower frame disposed below the support plate; and a first rod pivotably coupled to the lower frame and supporting the support plate, the first rod configured to lift the support plate against the lower frame, and wherein the second connection part protrudes from a pivot point of the first rod and coupled to the driving device through the connection hole.

3. The refrigerator of claim 2, wherein the elevation device comprises:

a plate pivotably coupled to the lower frame and extending along the first rod; and a second rod supported by the lower frame and rotatably coupled to the first rod, the second rod intersecting with the first rod, and wherein the second rod is located between the first rod and the plate.

4. The refrigerator of claim 3, wherein the plate and the first rod are connected to each other.

5. The refrigerator of claim 3, wherein the plate comprises a plurality of hexagonal holes arranged along a longitudinal direction of the first rod.

6. The refrigerator of claim 2, wherein the second connection part extends along the first rod.

7. The refrigerator of claim 2, wherein the connection hole is formed at a lower side of a front surface of the storage room and is located adjacent to a lateral side of the storage room.

8. The refrigerator of claim 1, wherein the elevation device comprises:

a pair of scissor assemblies supporting the support plate and located side by side, the pair of scissor assemblies configured to lift the support plate by the driving device.

9. The refrigerator of claim 8, wherein the driving device comprises:

a first gear driven by a drive motor; and a pair of second gears meshed with the first gear and driving the pair of scissor assemblies respectively.

10. The refrigerator of claim 8, wherein the elevation device comprises a lower frame below the support plate, the pair of scissor assemblies located between the support plate and the lower frame, wherein each of the pair of scissor assemblies comprises:

a first rod pivotably coupled to the lower frame and supporting the support plate; and a second rod rotatably coupled to the first rod supported by the lower frame, and wherein the first rods of the pair of scissor assemblies extend inward of the elevation device from the lower frame.

11. The refrigerator of claim 10, wherein the elevation device further comprises an upper frame supporting the support plate and supported by the first rods of the pair of scissor assemblies, and wherein the second rods of the pair of scissor assemblies are pivotably coupled to the upper frame and extend inward of the elevation device from the upper frame.

12. The refrigerator of claim 1, wherein the driving device comprises:

a drive gear connected to a shaft of a drive motor;

a screw unit comprising:

a screw extending upward and driven by the drive gear; and a screw holder moving along the screw; and a lever comprising the first connection part, the lever engaged with the screw holder.

13. The refrigerator of claim 12, wherein the elevation device comprises:

a lower frame disposed below the support plate; and a rod pivotably coupled to the lower frame and supporting the support plate, the rod configured to lift the support plate against the lower frame, and wherein the second connection part protrudes from a pivot point of the first rod, the second connection part inserted into the first connection part through a connection hole formed at the storage room.

14. The refrigerator of claim 12, wherein the drive gear is located at a front of the motor, wherein the drive gear and the screw are positioned side by side, and wherein an end of the lever engaged with the screw holder is located at a rear of the screw holder.

15. The refrigerator of claim 12, wherein the lever comprises a lever hole located at an end engaged with the screw holder, the lever hole extending in a longitudinal direction of the lever, and wherein the driving device further comprises a holder engaging member engaged with the screw holder through the lever hole.

16. The refrigerator of claim 1, wherein the second connection part extends forward, passes through the connection hole, and is inserted into the first connection part.

17. The refrigerator of claim 1, wherein the second connection part comprises:

a first portion having an arc-shaped outer surface; and a second portion protruding radially outward from the outer surface of the first portion.

* * * * *